US011796180B2

(12) United States Patent
Vandrak et al.

(10) Patent No.: US 11,796,180 B2
(45) Date of Patent: Oct. 24, 2023

(54) SYSTEMS AND ARRANGEMENTS FOR PORTABLE HEATER WITH CONNECTABLE ACCESSORY

(71) Applicant: Enerco Group, Inc., Cleveland, OH (US)

(72) Inventors: Brian Vandrak, Highland Heights, OH (US); Mike Mullins, Kirtland, OH (US); John Talbot, Bay Village, OH (US); Shawn Dellinger, Cleveland, OH (US); Brian Streisel, Garrettsville, OH (US); Jeff Kerner, Brecksville, OH (US)

(73) Assignee: ENERCO GROUP INC., Cleveland, OH (US)

( * ) Notice: Subject to any disclaimer, the term of this patent is extended or adjusted under 35 U.S.C. 154(b) by 557 days.

(21) Appl. No.: 16/935,797

(22) Filed: Jul. 22, 2020

(65) Prior Publication Data

US 2021/0080112 A1 Mar. 18, 2021

Related U.S. Application Data

(60) Provisional application No. 62/900,832, filed on Sep. 16, 2019.

(51) Int. Cl.

| | |
|---|---|
| ***F24C 5/18*** | (2006.01) |
| ***F23K 5/04*** | (2006.01) |
| ***F23K 5/14*** | (2006.01) |

(52) U.S. Cl.

CPC ..... *F24C 5/18* (2013.01); *F23K 5/04* (2013.01); *F23K 5/147* (2013.01); *F23N 2241/02* (2020.01)

(58) Field of Classification Search

CPC .... F24C 5/18; F24C 5/20; F24C 3/022; F24C 3/14; F24C 15/18; F24C 15/30;

(Continued)

(56) References Cited

U.S. PATENT DOCUMENTS 662,191 A * 11/1900 Ge Frorer ..... F24C 3/14 126/38
3,140,740 A * 7/1964 Lagreid ..... F24C 3/14 62/48.1

(Continued)

FOREIGN PATENT DOCUMENTS

CA 2886375 A1 * 5/2014 ..... F24C 3/126
CN 201373479 Y 12/2009

(Continued)

*Primary Examiner* — Steven B McAllister
*Assistant Examiner* — Daniel E. Namay
(74) *Attorney, Agent, or Firm* — CALFEE, HALTER & GRISWOLD LLP

(57) ABSTRACT

A portable heater includes a housing enclosing a combustion region, a first connector for connecting with a fuel source, a first supply line in fluid connection with the first connector for supplying fuel to the combustion region when the fuel source is connected with the first connector, a second supply line in fluid connection with a second connector for supplying fuel to a fuel-fired accessory when the fuel source is connected with the first connector and the fuel-fired accessory is connected with the second connector, and a valve arrangement operable to selectively supply fuel to the first and second supply lines when the fuel source is connected with the first connector.

19 Claims, 14 Drawing Sheets

(58) Field of Classification Search
CPC ..... F23K 5/04; F23K 5/147; F23N 2241/02; F23C 6/02; F24D 15/02; F24D 15/00; A21B 1/52; A47J 37/0713; A47J 37/0727; A47J 37/0763; A47J 37/07; A47J 2037/0777
USPC ..... 126/85 R, 248, 4, 37
See application file for complete search history.

(56) References Cited

U.S. PATENT DOCUMENTS 3,386,656 A 6/1968 Gergquist
3,763,848 A * 10/1973 Williams ..... F24C 13/00 237/19
4,524,751 A * 6/1985 Hoglund ..... F24C 3/14 126/41 R
4,587,948 A * 5/1986 Haglund ..... F24C 3/14 126/41 R
4,817,582 A 4/1989 Oslin et al.
5,313,928 A * 5/1994 Rodgers ..... A47J 37/0763 126/41 R
5,423,308 A * 6/1995 Huang ..... F24C 3/14 126/38
7,793,649 B2 * 9/2010 Barkhouse ..... F23N 1/002 126/41 R
8,381,712 B1 * 2/2013 Simms, II ..... A47J 37/0713 126/2
8,475,162 B2 7/2013 Barritt et al.
8,487,221 B2 7/2013 Vandrak et al.
9,127,847 B2 * 9/2015 Wylde ..... F24C 3/02
2005/0053885 A1 * 3/2005 Kuo ..... F23K 5/22 431/278
2006/0180139 A1 8/2006 Proffitt et al.
2006/0185660 A1 8/2006 Sords
2006/0191528 A1 * 8/2006 Spangrud ..... A47J 37/0781 126/275 R
2008/0271456 A1 * 11/2008 Scully ..... F02C 9/263 60/740
2014/0137850 A1 * 5/2014 Wylde ..... F24C 3/02 126/39 B
2015/0159773 A1 * 6/2015 Civilla ..... F16K 31/465 126/39 N
2015/0338100 A1 11/2015 Deng
2016/0206148 A1 * 7/2016 Sawhney ..... A47J 37/0763
2016/0348922 A1 * 12/2016 Knight ..... A47J 37/0713
2018/0292091 A1 * 10/2018 Kim ..... F24C 3/082
2019/0145621 A1 * 5/2019 Turner ..... H01L 35/30 126/25 R
2020/0096204 A1 * 3/2020 Ruben ..... G05B 19/042
2021/0262667 A1 * 8/2021 Lv ..... G05D 16/0669

FOREIGN PATENT DOCUMENTS

CN 113491450 A * 10/2021 ..... A47J 37/0611
EP 1160520 A2 5/2001

* cited by examiner

SYSTEMS AND ARRANGEMENTS FOR PORTABLE HEATER WITH CONNECTABLE ACCESSORY

CROSS-REFERENCE TO RELATED APPLICATION

This application claims priority to and all benefit of U.S. Provisional Patent Application Ser. No. 62/900,832, filed on Sep. 16, 2019, entitled SYSTEMS AND ARRANGEMENTS FOR PORTABLE HEATER WITH CONNECTABLE ACCESSORY, the entire disclosure of which is incorporated herein by reference.

BACKGROUND

Fuel-fired portable heaters such as forced-air heaters and infrared heaters are used in multiple environments. Such heaters typically include a housing having a combustion chamber. The housing has an inlet for receiving air into the chamber and a fuel supply line for supplying fuel into the chamber. A mixture of fuel and air is introduced into the chamber where combustion occurs, to generate heat. In a conventional forced air heater, an electric powered fan is operated to draw ambient air into the heater to be heated by the combustion of the air/fuel mixture and then expelled out of the heater by the fan. In a conventional infrared heater, a plenum directs the air/fuel mixture toward a heating surface of a burner element (e.g., tile or screen) where the air/fuel mixture is ignited (e.g., by a pilot flame or other ignition source), thereby providing radiant, infrared heat to an adjacent space.

SUMMARY

The present disclosure contemplates systems and arrangements for providing a portable heater with a connectable accessory for storage, transportation, and/or use with the portable heater.

In an exemplary embodiment of the present disclosure, a portable heater includes a housing enclosing a combustion region, a first connector for connecting with a fuel source, a first supply line in fluid connection with the first connector for supplying fuel to the combustion region when the fuel source is connected with the first connector, a second supply line in fluid connection with a second connector for supplying fuel to a fuel-fired accessory when the fuel source is connected with the first connector and the fuel-fired accessory is connected with the second connector, and a valve arrangement operable to selectively supply fuel to the first and second supply lines when the fuel source is connected with the first connector.

In another exemplary embodiment of the present disclosure, a portable heater including a combustion region enclosed within a housing is provided in combination with a mountable accessory. One of the portable heater and the mountable accessory includes opposed mounting rails, and the other of the portable heater and the mountable accessory includes at least one latch configured to attach to at least one of the mounting rails.

In another exemplary embodiment of the present disclosure, a mountable accessory for connection with a portable heater includes a housing, a release lever having a user graspable first end and a second end hingedly connected to the housing at a first hinge portion, and at least one latch portion having a first end for interlocking with a mounting rail of a portable heater and a second end hingedly connected to the release lever at a second hinge portion offset from the first hinge portion, such that pivoting movement of the release lever from an engaging position to a releasing position extends the latch portion to disengage the first end from the mounting rail.

These and other aspects and advantages of the inventions described herein will be readily appreciated and understood by those skilled in the art in view of the accompanying drawings.

BRIEF DESCRIPTION OF THE DRAWINGS

Further features and advantages of the inventions will become apparent from the following detailed description made with reference to the accompanying drawings, which are not necessarily (but may be) drawn to scale, wherein.

DETAILED DESCRIPTION

The Detailed Description merely describes exemplary embodiments and is not intended to limit the scope of the claims in any way. Indeed, the invention as claimed is broader than and unlimited by the exemplary embodiments, and the terms used in the claims have their full ordinary meaning. For example, while specific exemplary embodiments in the present disclosure describe portable propane-fueled infrared heaters with connected, propane-fueled accessories, one or more of the features described herein may additionally or alternatively be applied to other types of arrangements, including, for example, non-portable heaters, forced air heaters, electric heaters, or heaters with electric powered or non-powered connected accessories.

According to an exemplary aspect of the present disclosure, a fuel-fired (e.g., propane, butane, kerosene, gasoline) heater may be provided with an arrangement to divert fuel supplied to the heater (e.g., from an attached fuel tank) to a connected fuel-fired accessory, such as a stove, lamp, or coffee maker, thereby eliminating the need to provide a separate fuel or power source for the accessory.

Figure 1:
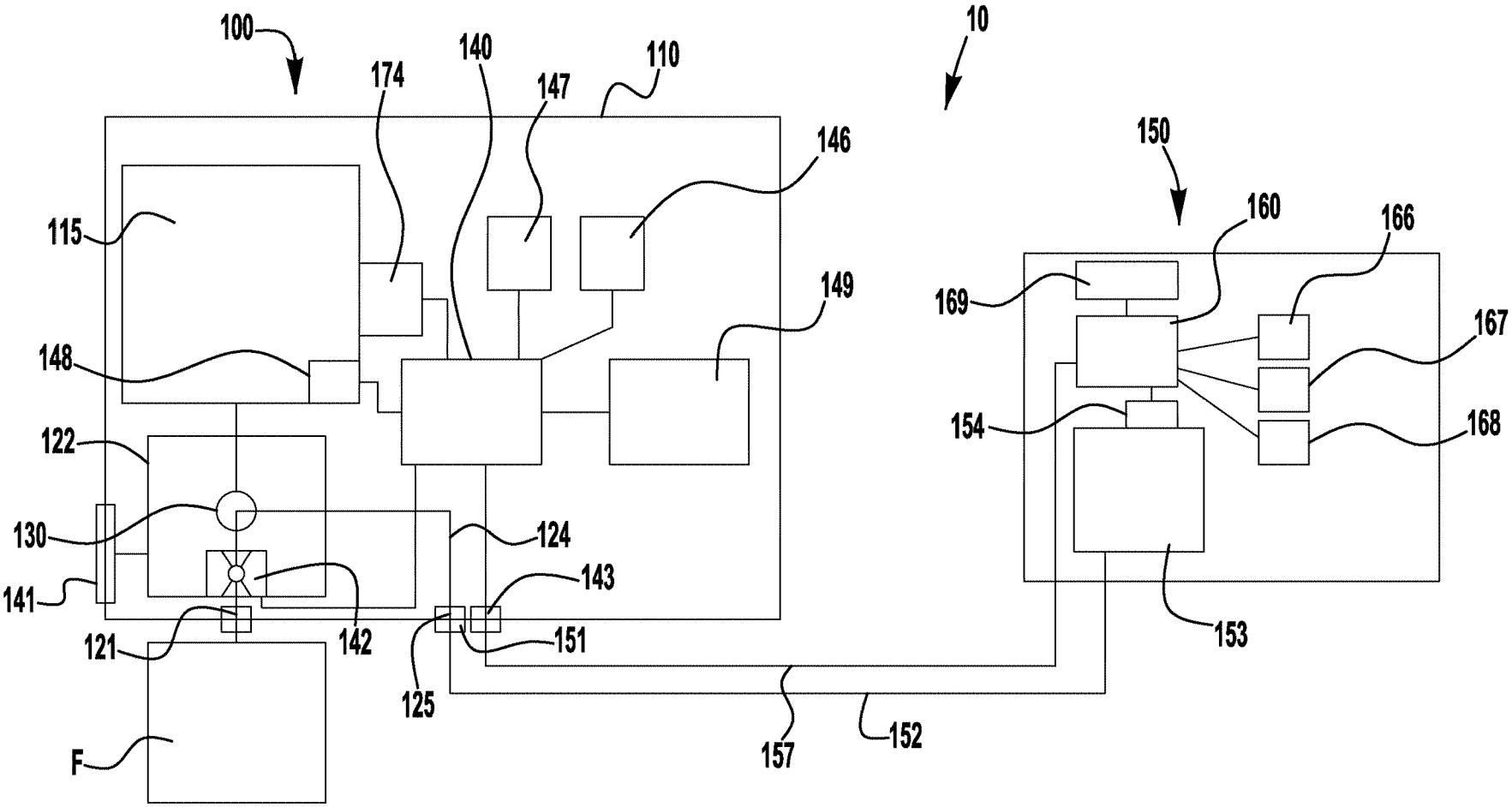
FIG. 1 is a schematic diagram of an exemplary heating system including a portable heater and a fuel-fired accessory, according to an exemplary embodiment of the present disclosure.

FIG. 1 is a schematic diagram of an exemplary system 10 including a fuel-fired heater 100 and fuel-fired accessory 150, in accordance with one or more of the exemplary embodiments described herein. In the illustrated embodiment, the heater 100 includes a housing 110 enclosing a combustion region 115, in which the combustion of fuel takes place. As used herein, "fuel" may include, but is not limited to, propane, natural gas, butane, kerosene, and/or other such suitable fuels, and or a fuel-air mixture including any one or more of these suitable fuels. In an exemplary embodiment, the combustion region 115 includes a radiant surface defined by a burner element (e.g., burner tile(s) and/or screen(s)) through which the fuel may pass to define an area of combustion. The heater 100 includes an ignitor 174 for igniting fuel supplied to the combustion region 115.

To supply fuel to the combustion region 115, a fuel source F (e.g., from a utility supply connection or fuel tank) is connected to a first connector or tank connector 121, for example, using a conventional threaded connect, to supply fuel to a first fuel supply line or burner supply tube 122 for delivery of the fuel to the combustion region. As used herein, "tube" may include any suitable conduit, including any flexible or rigid tube, pipe, or hose. The burner supply tube 122 may extend to a burner venturi and combustion chamber, as described in greater detail below.

To supply fuel to the accessory 150, the heater 100 includes a second fuel supply line or accessory supply tube 124 providing fluid communication between the tank connector 121 and a second connector or accessory fueling connector 125 carried by the housing 110 and configured for connection with an accessory supply connector 151 on the accessory 150. The accessory supply connector 151 is connected with a fuel consuming feature 153 (e.g., burner, lantern element) of the accessory 150 by an accessory supply line (e.g., hose) 152. The accessory 150 includes an ignitor 154 for igniting fuel supplied to the fuel consuming feature 153.

To control the supply of fuel to the combustion region 115 and accessory 150, the heater 100 includes a valve arrangement 130 connecting the tank connector 121 with the first and second fuel supply lines 122, 124. In an exemplary embodiment, the valve arrangement 130 is selectively operable between at least three positions—(a) a first "heater on" position in which fuel is only supplied to the first fuel supply line or burner supply tube 122 (and not the second fuel supply line) for fueling the heater; (b) a second "accessory on" position in which fuel is only supplied to the second fuel supply line or accessory supply tube 124 (and not the first fuel supply line) for fueling the accessory; and (c) a third "shutoff" position in which the supply of fuel is blocked or closed to both first and second fuel supply lines 122, 124. In such an embodiment, the valve arrangement may be such that the simultaneous supply of fluid to both the combustion region and the accessory is prevented, for example, to deter use of the heater and accessory within a tent or other enclosure. In other embodiments, the valve arrangement may additionally or alternatively be operable to a "both on" position in which fuel is supplied to the first and second fuel supply lines 122, 124 to simultaneously fuel both the heater 100 and the accessory 150. In still other embodiments, the valve arrangement may additionally or alternatively allow for metered adjustment of fuel flow to either or both of the first and second fuel supply lines, for example, to control the flow rate of the supplied fuel and the resulting heat or energy generated by the heater and/or accessory.

Many different types of valve arrangements may be utilized. As one example, the valve arrangement may include a three-way switching valve operable between a first switching position corresponding to the "heater on" position, a second switching position corresponding to the "accessory on" position, and a shutoff position. As another example the valve arrangement may include two shutoff valves, with a first shutoff valve controlling fuel flow to the first fuel supply line ("heater on" and "heater off" positions), and a second shutoff valve controlling fuel flow to the second fuel supply line ("accessory on" and "accessory off" positions). Either or both of the shutoff valves may (but need not) be operable to meter or regulate the flow rate to either or both of the first and second fuel supply lines.

The valve arrangement 130 may include one or more manually operated valves controlled, for example, by user rotatable knobs or handles disposed on a control interface 141 on the heater housing 110. Additionally or alternatively, the valve arrangement may include one or more electronically operated valves controlled, for example, by wired or wireless signals from the heater control interface 141 (e.g., pushbutton and/or touchscreen interface) or remote user device (e.g., remote control unit or smartphone).

According to an exemplary aspect of the present disclosure, the heater 100 may be provided with an electronic control system configure to limit or restrict operation of the heater and/or accessory, for example, based on sensed conditions of the heater and/or accessory. In the illustrated embodiment, the heater 100 includes a controller or microprocessor 140 disposed within the housing 110 and operatively connected with an electronically operated shutoff valve 142 (e.g., solenoid valve), and in communication (e.g., wired or wireless) with a sensor arrangement carried by (e.g., enclosed within or mounted to) the housing 110. The sensor arrangement includes one or more sensors 146, 147, 148 configured to continuously or periodically monitor one or more conditions of the heater, and to transmit signals corresponding to these detected conditions to the controller 140. As one example, an environmental sensor 147, such as, for example, a pilot-based oxygen depletion sensor, flameless gas (e.g., carbon dioxide, carbon monoxide, oxygen) sensor, chemical based sensor, or infrared-based sensor, may be provided to detect ambient conditions in which heater use may be undesirable, including, for example, levels of carbon dioxide and/or oxygen in the ambient air. As another example, a flame sensor 148 (e.g., thermocouple) may be provided to detect the absence of a pilot flame or burner flame (i.e., a condition in which continued supply of fuel would be undesirable, or a condition consistent with a depleted fuel source). As another example, a temperature sensor (e.g., thermocouple) may be provided to detect temperatures at the heater (e.g., to identify excessive heat conditions). As another example, a tip-over sensor 146 may be provided to detect a tipped over condition of the heater.

When a sensor 146, 147, 148 detects a condition indicative of an undesired environment for operation of the heater 100 and/or accessory 150 (e.g., low levels of oxygen, high levels of carbon dioxide, extreme temperature, or a tipped over condition), the controller 140 may be configured to actuate the shutoff valve 142 to block the supply of fuel to the first and second fuel supply lines 122, 124. In one such embodiment, the controller may transmit an actuating signal to the shutoff valve 142 to actuate the shutoff valve from the open position to the closed position. In another embodiment, the shutoff valve 142 may be a normally closed valve (e.g., solenoid valve) that receives an actuating signal during normal operation of the heater to maintain the shutoff valve in the open position. When a threshold condition is detected by the sensor(s), the controller 140 terminates transmission of the actuating signal to the shutoff valve 142 to cause the shutoff valve to return to the closed position.

As shown, the accessory 150 may, but need not, additionally include a controller 160 and a sensor arrangement including one or more sensors 166, 167, 168 configured to detect one or more conditions of the accessory, and to transmit signals corresponding to these detected conditions to the controller 160. As one example, an environmental detector or sensor 168, such as, for example, a pilot-based oxygen depletion sensor, flameless gas (e.g., carbon dioxide, carbon monoxide, oxygen) sensor, chemical based sensor, infrared-based sensor, may be provided to detect ambient conditions in which accessory use may be undesirable, including, for example, levels of carbon dioxide and/or oxygen in the ambient air. As another example, a flame sensor 167 may be provided to detect the absence of a pilot flame or burner flame (i.e., a condition in which continued supply of fuel would be undesirable). As another example, a temperature sensor (e.g., thermocouple) may be provided to detect temperatures at the accessory. As another example, a tip-over or anti-tip sensor 166 may be provided to detect a tipped over condition of the accessory.

When a sensor 166, 167, 168 detects a condition indicative of an undesired environment for operation of the accessory 150 (e.g., low levels of oxygen, high levels of carbon dioxide and/or carbon monoxide, extreme temperature, or a tipped over condition), the controller 160 may be configured to transmit a status signal, or discontinue transmission of a status signal, to the heater controller 140 to effect actuation of the shutoff valve 142 to block the supply of fuel to the burner and accessory supply tubes 122, 124. To provide for transmission of signals from the accessory controller 160 to the heater controller 140, electrical wiring 157 may be provided with the accessory 150, connected with the accessory controller 150 and connectable with the heater controller by an electrical port 143 disposed on the heater housing 110. Additionally or alternatively, the controller 160 may be provided with a wireless transmitter configured to wirelessly transmit a status signal to a wireless receiver of the heater controller 140.

According to another aspect of the present disclosure, the accessory controller 160 may be configured to transmit a status signal (e.g., via wired or wireless communication, as discussed above) identifying the accessory 150 as an accessory that is authorized for use with the heater—for example, an accessory for which safe use with the heater has been verified. When the status signal is not transmitted to the heater controller 140, for example, due to connection of an unauthorized accessory not configured to transmit the status signal, the heater controller is configured to actuate the shutoff valve 142 to the closed position (e.g., by transmitting an actuating signal to the shutoff valve, or by terminating transmission of an actuating signal to the shutoff valve).

In other embodiments, other mechanisms may be utilized to restrict use of unauthorized fuel-fired accessories with the heater. For example, the heater may be provided with a non-standard or proprietary accessory fueling connector (e.g., quick connect coupling) to limit accessory connection and use to accessories having a matching or complementary configured accessory supply connector. In one such exemplary arrangement, one of the accessory fueling connector 125 and the accessory supply connector 151 includes a female connector having a first keying feature, and the other of the accessory fueling connector 125 and the accessory supply connector 151 includes a male connector having a second keying feature sized and shaped for mating or close-fit engagement with the first keying feature to permit positive coupling or interconnection of the male and female connectors, while preventing positive coupling or interconnection of an otherwise mating connector that lacks the corresponding keying feature.

Figure 1A:
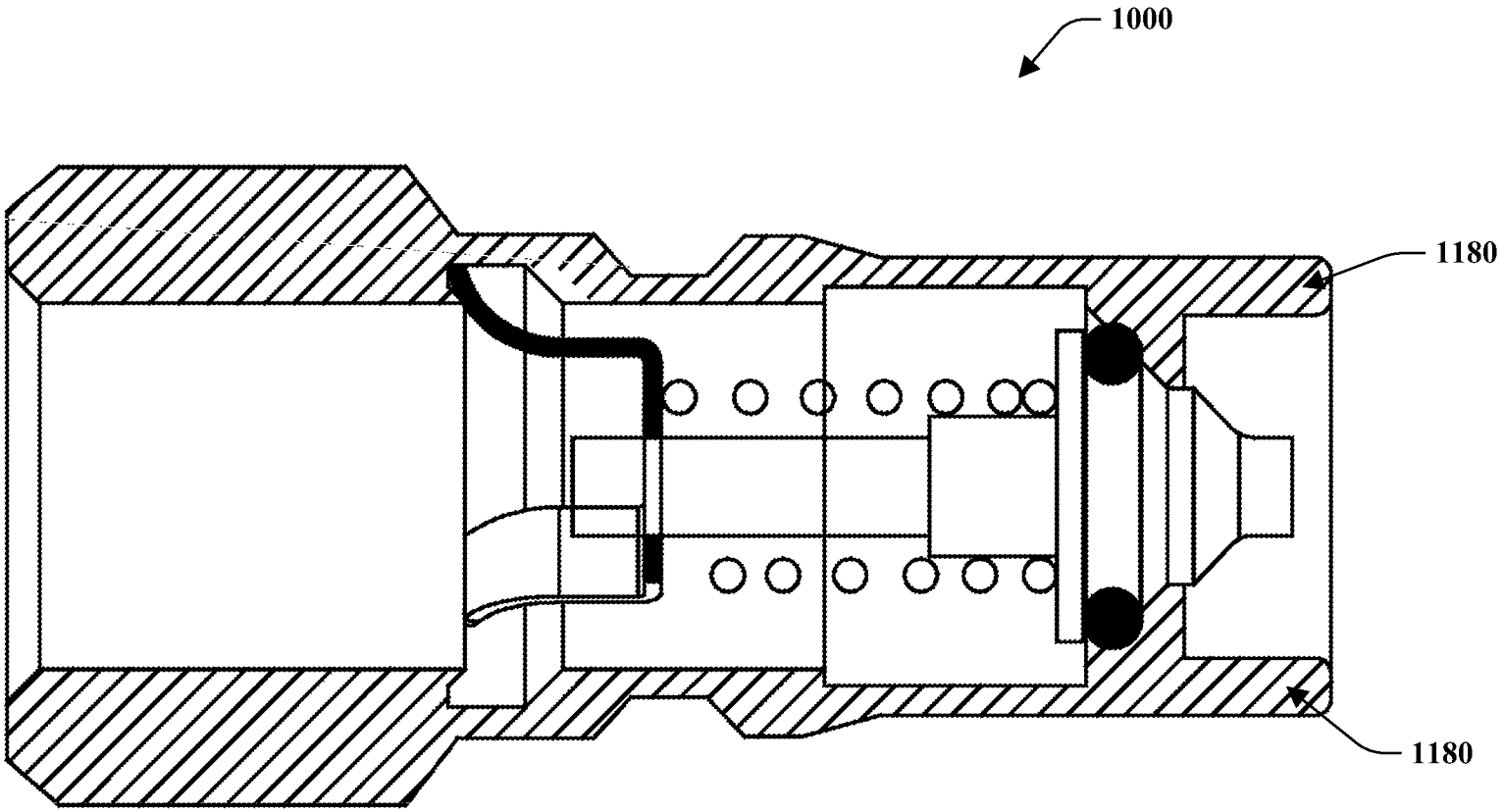
FIG. 1A is a side cross-sectional view of a male connector with a keying feature, according to an exemplary embodiment of the present disclosure.
Figure 1B:
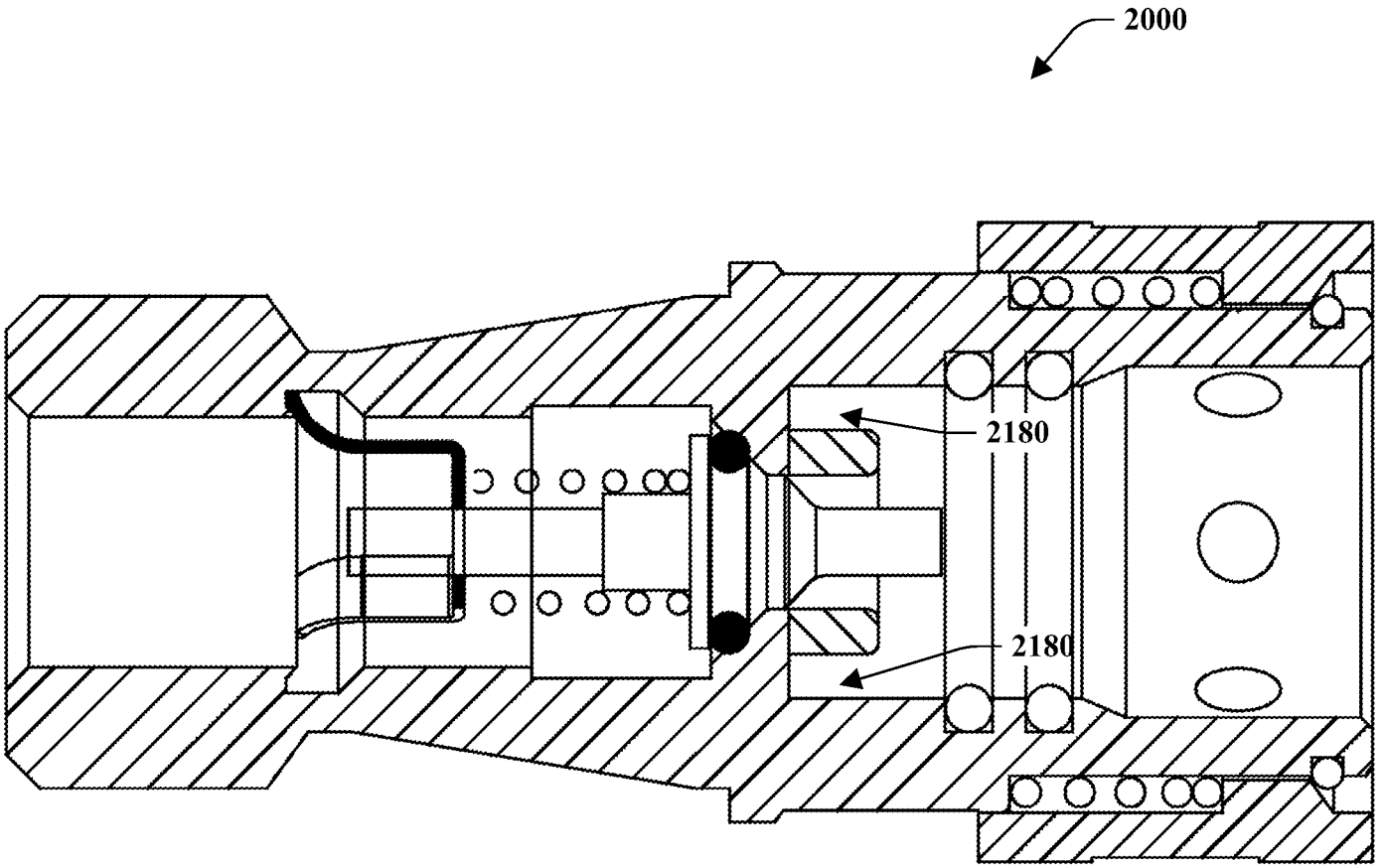
FIG. 1B is a side cross-sectional view of a female connector with a keying feature, according to an exemplary embodiment of the present disclosure.

Keying features on mating male and female connectors may include a variety of configurations. For example, one of the male and female connectors may include a recess, and the other of the male and female connectors may include one or more extensions sized and positioned to be received in the recess to permit positive coupling or interconnection of the male and female connectors. FIGS. 1A and 1B illustrate exemplary arrangement, including a male quick connect style connector 1000 and a female quick connect style connector 2000, with the male connector 1000 including an extension 1180 sized and shaped for mating, close-fit, or keying engagement with a recess 2180 in the female connector 2000. In one embodiment, the recess 2180 forms a circular groove to accommodate the extension 1180 in any rotational position of the male connector 1000 with respect to the female connector 2000. In such an embodiment, the extension 1180 may be tubular or may include one or more discrete protrusions positioned to align with the circular groove 2180 during coupling. In other embodiments, the recess may be non-circular, thereby limiting the relative rotational positions of the connectors that provide for positive coupling or interconnection. Other types of keying arrangements may additionally or alternatively be used, including, for example, combinations of extensions and recesses on both connectors.

As shown, the male and female connectors 1000, 2000 may be self-sealing connectors, with spring biased internal spools that seal the connectors when uncoupled and that force the spools to open positions when coupled. Exemplary keyed connections are described in greater detail in co-pending U.S. patent application Ser. No. 16/935,383, filed on Jul. 22, 2020 and entitled QUICK CONNECT SYSTEM AND METHOD (the "'383 Application"), and co-pending U.S. Design patent application Ser. No. 29/743,500, filed on Jul. 22, 2020 and entitled QUICK CONNECT (the "'500 Application"), the entire disclosures of both of which are incorporated herein by reference.

In still other embodiments, the heater may be provided with a special or non-standard electrical port to limit accessory connection and use to accessories having electrical wiring with a matching or complementary configured electrical connector.

Referring back to FIG. 1, a power source 149 is connected (directly or indirectly) with the controller 140, the shutoff valve 142, the ignitor 174, the sensors 146, 147, 148, and optionally, an accessory controller 160 and accessory sensors 166, 167, 168 (via electrical wiring 157) and/or any other electrically powered features of the heater 100 and accessory 150. The power source 149 may include any one or more of a variety of suitable arrangements, including, for example, a utility connection with an electrical outlet (via a plugged-in cord), one or more on-board batteries (e.g., internally installed or externally attachable, replaceable and/or rechargeable battery or batteries), or a thermoelectric generator. In other embodiments, the accessory may be provided with its own power source 169, to eliminate the need for any electrical wiring between the heater 100 and the accessory 150.

In other embodiments, the accessory may be provided with its own power source, for example, to eliminate the electrical connection between the heater and the accessory. In such an arrangement, the accessory may be provided with its own sensors and safety shutoff mechanisms. Alternatively, the heater's sensors may be utilized to sense conditions for the heater and accessory in combination, and to shut off the supply of fuel to both the heater burner and the accessory in response to a sensed condition.

Figure 4:
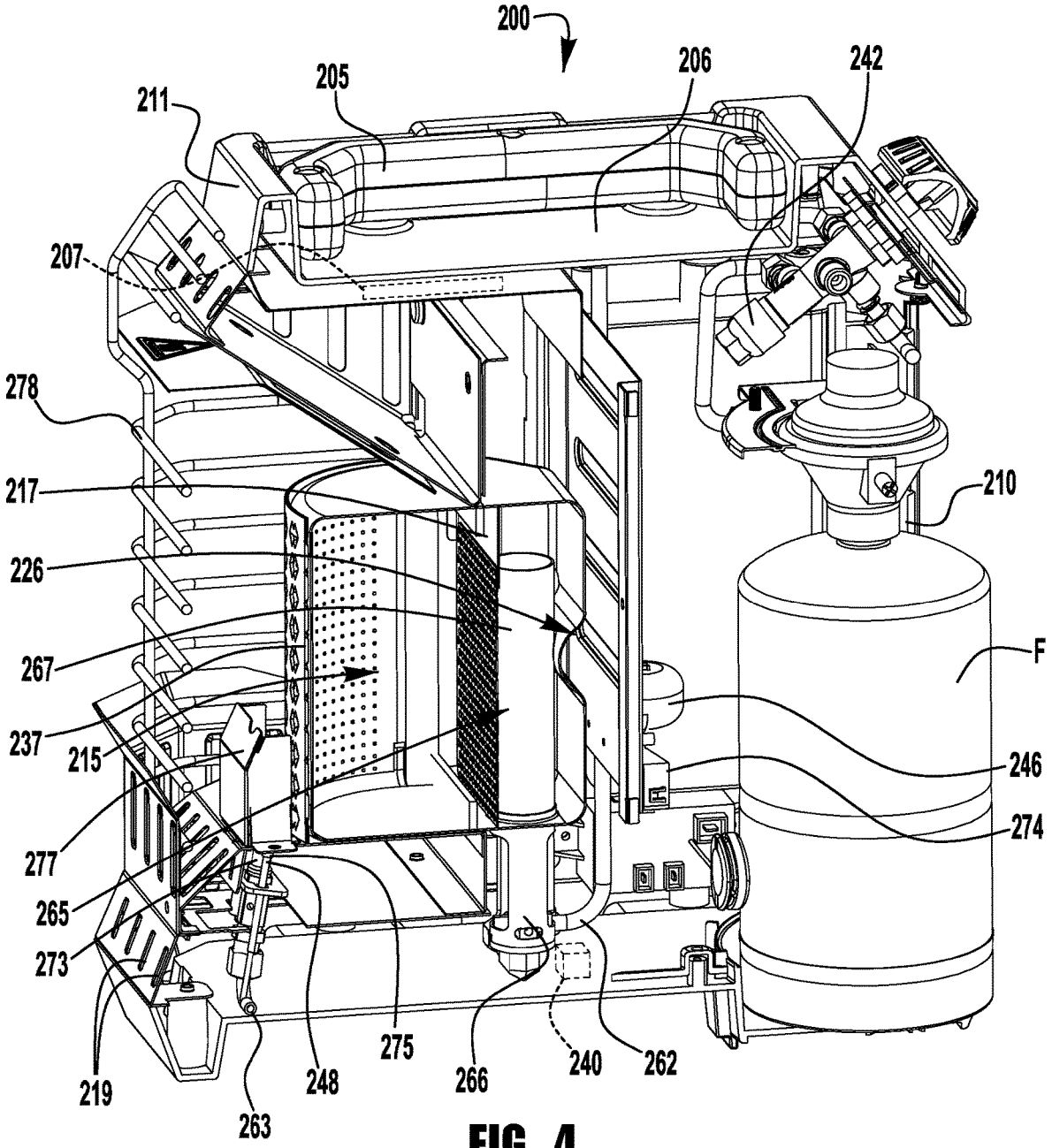
FIG. 4 is a side cross-sectional perspective view of the portable heater of FIG. 2.
Figure 5:
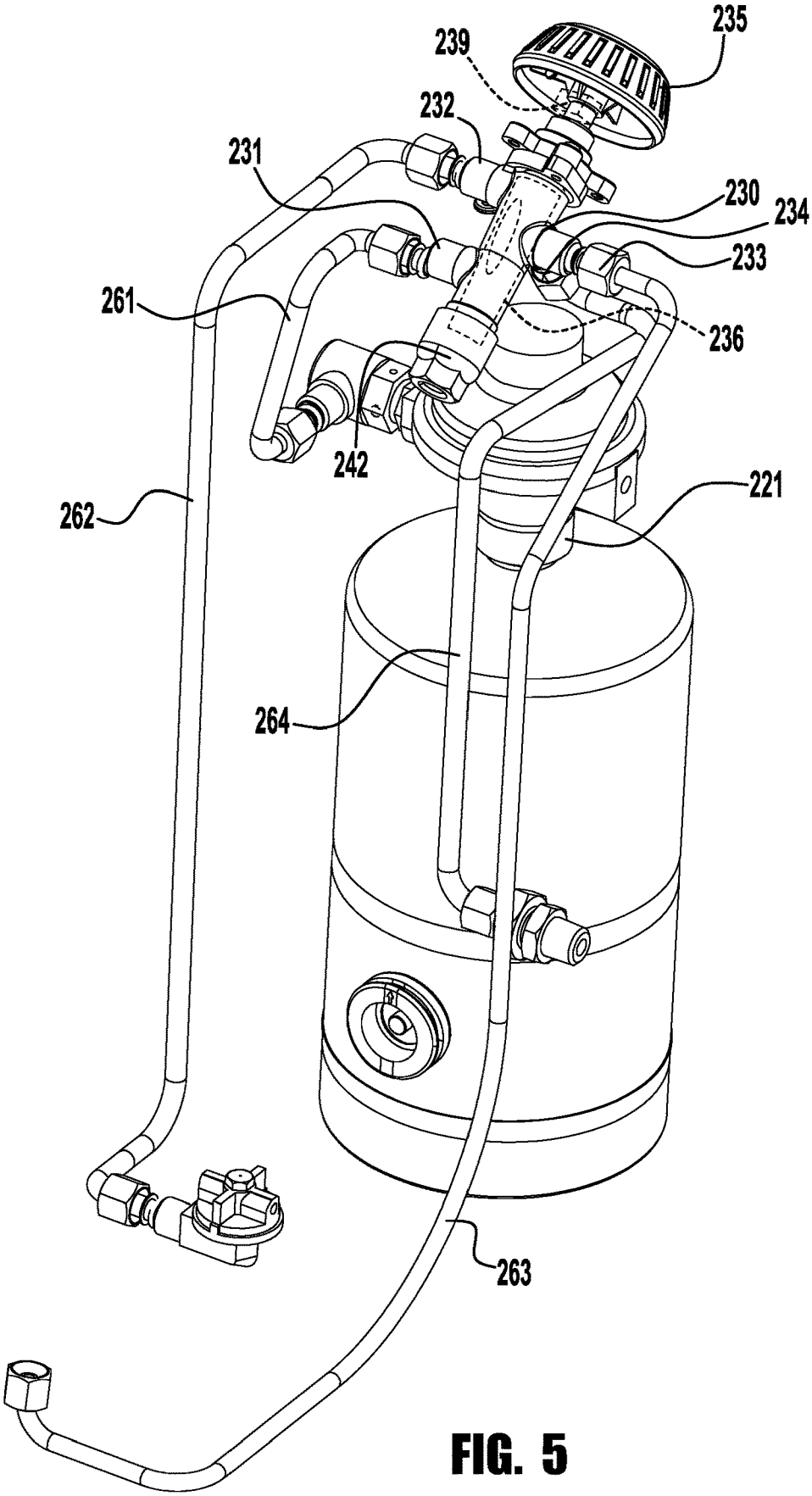
FIG. 5 is a perspective view of a fuel distribution arrangement of the portable heater of FIG. 2.
Figure 6:
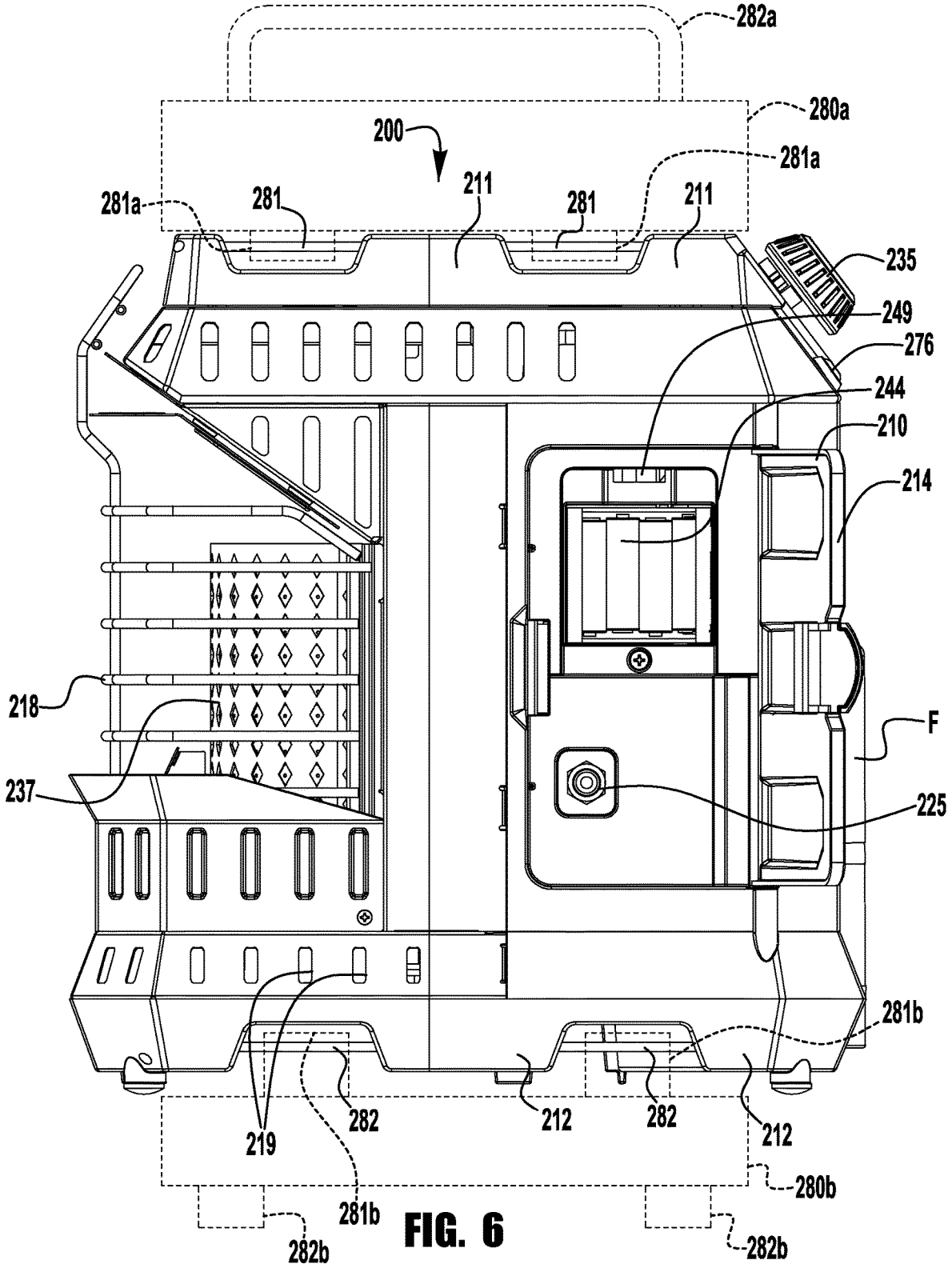
FIG. 6 is a side view of the portable heater of FIG. 2, with the access door removed to illustrate additional features of the heater.

FIGS. 2-6 illustrate an exemplary heater 200 in accordance with certain aspects of the present disclosure. The exemplary heater 200 includes a housing 210 enclosing a combustion region 215 (see FIG. 4), in which a fuel (e.g., an air/fuel mixture) is combusted to generate heat. As best shown in FIG. 5, replaceable fuel tank F (or other fuel source) is connected to a first connector or tank connector 221 (e.g., pivotable threaded connector), which is connected to an inlet port 231 of a user operable supply valve or valve arrangement 230 (e.g., by an inlet conduit 261) to supply fuel from the tank F to the supply valve 230. In the illustrated embodiment, the supply valve 230 is a manually operated switching valve including a first or burner outlet port 232 connected with a first or burner supply tube 262, a second or pilot outlet port 233 connected with a second or pilot supply tube 263, and a third or accessory outlet port 234 connected with a third or accessory supply tube 264. In operation, the supply valve 230 is adjustable between an off position and multiple switching positions to supply fuel to one or more of the supply tubes 262, 263, 264, as described in greater detail below. While many different valve actuating arrangements may be utilized, in the illustrated embodiment, a rotatable knob 235 connected with an actuating stem of the supply valve 230 is provided on the heater housing 210 for user rotation between selected valve positions.

Many different fuel distribution and combustion arrangements may be utilized to fuel the heater 200. In the illustrated embodiment, as shown in FIG. 4, the burner supply tube 262 extends to a lower mouth portion 266 of a venturi tube 265 in the combustion region 215. When the supply valve 230 is in a "heater on" position, as discussed in greater detail below, the venturi tube 265 receives fuel from the burner supply tube 262 and air from air inlet openings 219 (e.g., slits) in the heater housing 210 to generate an air/gas mixture that travels upward through a cylindrical body 267 of the venturi tube and is discharged to a combustion chamber 226 adjacent to a baffle 217 arranged to distribute fuel laterally outward and toward a radiant surface defined by a burner element 237 (e.g., screen or tile). In the illustrated embodiment, the burner element 237 includes a semi-cylindrical portion extending into an open front portion of the heater housing 210, enclosed by a grill guard 278, to define a multi-directional (e.g., 180°) heating pattern for the heater. The burner element 237 defines an array of small openings which permit combustion of the air/gas mixture as it passes therethrough.

A mechanism is provided for initially sparking or igniting the air/gas mixture at the radiant surface of the burner element 237. While many different mechanisms may be utilized, in the illustrated embodiment, a pilot burner 273 is positioned outside the burner element 237 and is connected to the pilot supply tube 263 to receive fuel from the fuel tank F when the supply valve 230 is in a "pilot on" switching position, as discussed in greater detail below. An ignitor 274 (e.g., piezoelectric ignitor, electronic spark ignitor) is electrically connected with an electrode 275 positioned adjacent to the pilot burner 273 for igniting a pilot flame at the pilot burner. In the illustrated embodiment, an ignition button 276 (FIG. 2) is disposed on the heater housing 210 (e.g., adjacent to the valve control knob 235) and is electrically connected with the ignitor 274 for user actuation of the ignitor, to generate and transmit a spark producing current to the electrode 275. The pilot flame functions to ignite the air/gas mixture passing through the burner element 237 or burner tile. A shield plate 277 may be secured to the housing to cover the pilot burner 273 and electrode 275, for example, to protect the pilot flame from being blown out.

In exemplary embodiments, combustion of the air/gas mixture is maintained and reaches elevated temperatures of approximately 1200° F. The exemplary heater 100, utilizing a single propane cylinder, may be rated at a minimum 4000 BTUs/hr and a maximum 10,000 BTUs/hr at eleven inches water column pressure. In some embodiments, an increased rating, for example, about 11,000 BTU's/hr, may be used, for example, to generate a brighter condition of the burner element 237. In other embodiments, greater heat generation may be provided, including up to 20,000 to 25,000 BTUs/hr, when more than one propane cylinder and/or associated burner assemblies are utilized.

To supply fuel to a fuel-fired accessory (e.g., boiler/stove, lantern, coffee maker, boot/gear drying apparatus), the heater 200 includes an accessory fuel connector 225 (e.g., quick connect style coupling connect) for connecting with a corresponding accessory supply connector of a fuel-fired accessory. The accessory fuel connector 225 is connected to or in fluid communication with the accessory supply tube 264 to receive fuel from the fuel tank F when the supply valve is in an "accessory on" switching position, as described in greater detail below. The accessory fueling connector 225 may be provided at a variety of suitable locations on the heater. In the illustrated embodiment, the accessory fueling connector 225 is disposed on a side wall of the housing 210, covered by a hinged access door 214 when not in use, for example, to protect the connector 225 from damage or contamination. As described above and in the above incorporated '383 and '500 Applications, the accessory fuel connector 225 may include a keying feature for limiting connection to a correspondingly keyed connector of an authorized fuel filed accessory. In other embodiments, the second connector 225 may provide a permanent connection to a fuel fired accessory that may be carried with (e.g., mounted to) the portable heater.

While the heater 200 may be configured to provide many different fuel supplying configurations, in one exemplary arrangement, the supply valve 230 and operating knob 235 are configured to provide six different selectable valve positions: (1) off, (2) ignition, (3) low heat, (4) high heat, (5) accessory ignition, and (6) accessory on. In the "off" position, the supply valve 230 blocks flow between the inlet port 231 and all three of the burner outlet port 232, the pilot outlet port 233, and the accessory outlet port 234. In the "ignition" position, the supply valve 230 permits fuel flow from the inlet port 231 to the pilot outlet port 233 only, allowing for ignition of the pilot flame. In the "low heat" position, the supply valve 230 permits a first, lower flow of fuel from the inlet port 231 to the burner outlet port 232, while permitting fuel flow to the pilot outlet port 233 to maintain the burner fuel igniting pilot flame. In the "high heat" position, the supply valve 230 permits a second, higher flow (relative to the low heater position) of fuel from the inlet port 231 to the burner outlet port 232, while permitting fuel flow to the pilot outlet port 233 to maintain the burner fuel igniting pilot flame. In the "accessory ignition" position, the supply valve 230 permits fuel flow from the inlet port 231 to the pilot outlet port 233 only, allowing for re-ignition of the pilot flame after the heater has been turned off (e.g., for monitoring gas supply, as described in greater detail below). In the "accessory on" position, the supply valve 230 permits a flow of fuel from the inlet port 231 to the accessory outlet port 234, while permitting fuel flow to the pilot outlet port 233 to maintain the pilot flame (e.g., for monitoring gas supply, as described in greater detail below).

In other embodiments, other valve switching configurations may be provided. As one example, the supply valve may be configured to have one or more additional burner fuel flow level/heat positions to provide further heat variability, including, for example, arrangements for which the regulated flow of fuel to the burner outlet port is infinitely variable between minimum and maximum heat conditions (e.g., by rotation of a regulating valve element controlling the effective size of a valve orifice between the inlet port and the burner outlet port. Alternatively, a valve switching arrangement may be configured to provide a single "heater on" position, eliminating the ability to adjust the level of fuel flow to the burner (and resulting heat generation).

As another example, the supply valve may be configured to have multiple accessory fuel flow level positions to provide accessory fuel level variability, including, for example, arrangements for which the regulated flow of fuel to the accessory outlet port is infinitely variable between minimum and maximum heat conditions (e.g., by rotation of a regulating valve element controlling the effective size of a valve orifice between the inlet port and the burner outlet port. Alternatively, as described in greater detail below, the accessory may be provided with its own regulating valve for controlling fuel flow to a fuel consuming feature of the accessory, with the supply valve providing only a single, full flow rate of fuel to the accessory outlet port.

As another example, the supply valve may be configured to have at least one position in which fuel flow to both the burner (via the burner outlet port) and the accessory (via the accessory outlet port) is permitted, for example, for simultaneous use of the heater and the fuel-consuming feature of the accessory.

As another example, the supply valve may be configured to have an "accessory on" position for which flow of fuel to the heater pilot tube is shut off. Such an arrangement may be appropriate, for example, when using accessories having their own safety sensors, shutoff mechanisms, and/or electronic circuits for communicating with and/or controlling the heater. In such an arrangement, the above described "accessory ignition" valve position may be eliminated.

Figure 7:
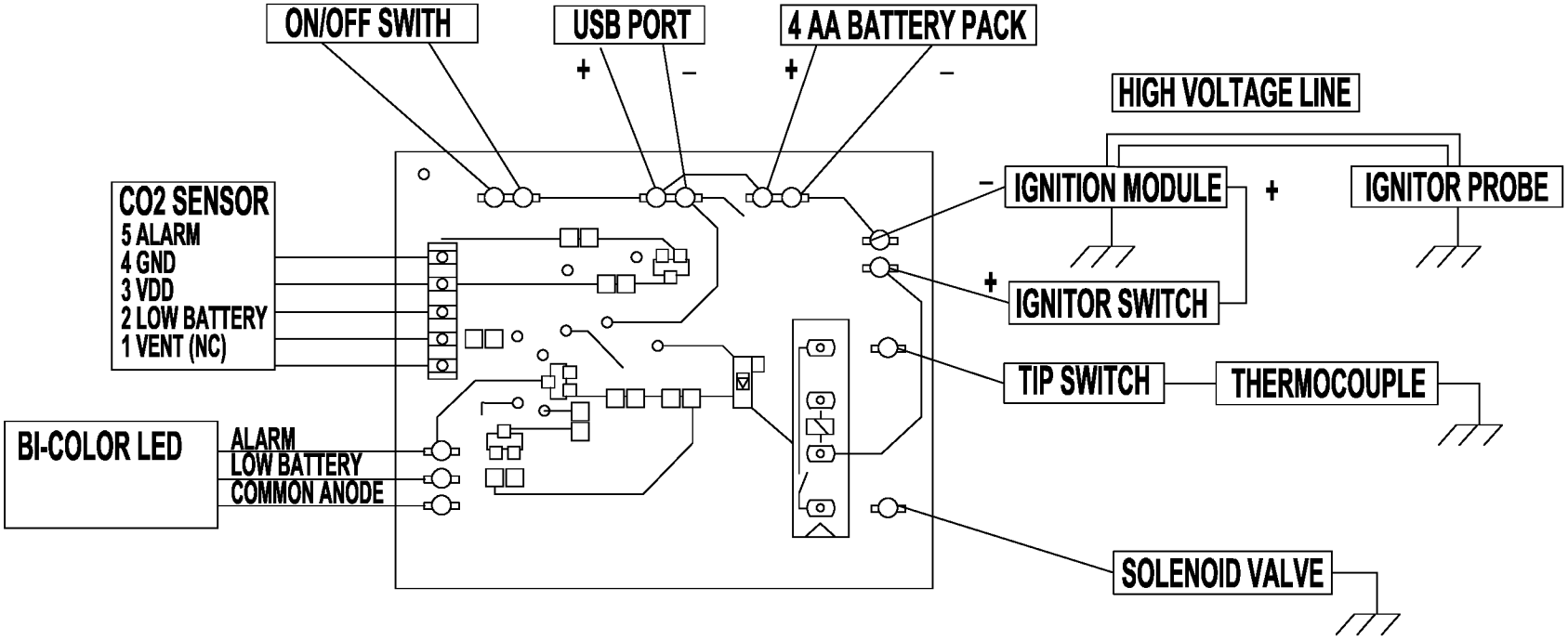
FIG. 7 is a plan view of an exemplary controller board for a heater.

As discussed more generally above, the exemplary heater 200 may be provided with an electronic control system configure to limit or restrict operation of the heater and/or accessory, for example, based on sensed conditions of the heater and/or accessory. As shown, the exemplary heater 200 includes a controller 240 (e.g., PC board, as shown for example in FIG. 7) disposed within the housing 210 and electrically connected with an electronically operated shutoff valve 242 (e.g., solenoid valve) disposed between the tank connector 221 and the first and second fuel supply lines 262, 263 that is operable by the controller 240 to automatically shut off the flow of fuel from the supply valve 230 in response to the detection of a potentially hazardous condition. The shutoff valve 242 may be integral to or assembled with the supply valve 230 in such an arrangement that in a shutoff condition (e.g., in the absence of an electrical current from the controller 240), the shutoff valve 242 prevents or blocks the flow of fuel from the inlet conduit 261/inlet port 231 to the burner outlet port 232, the pilot outlet port 233, and the accessory outlet port 234. While a variety of supply/shutoff valve configurations may be utilized, in the illustrated embodiment, the supply valve includes an internal ported plug 236 (FIG. 5) that is rotatable, by rotation of the valve handle 235, to selectively open the inlet port 231 to a selected one or more of the burner outlet port 232, pilot outlet port 233, and accessory outlet port 234, while the shutoff valve 242 is configured to axially slide the ported plug 236 to a shutoff position blocking flow from the inlet port 231. One example of a three-outlet supply valve with integral safety shutoff valve is K-890SL-A30, manufactured by Chant Group.

One or more sensors may be electrically connected with the controller for transmitting a signal to the controller indicating that a potentially unsafe or undesirable condition may exist, causing the controller to actuate the shutoff valve to the closed or shutoff condition. As one example, a sensor may be provided to detect a condition in which the heater has tipped over or may tip over. In the illustrated embodiment, an anti-tip sensor 246 (FIG. 4) is provided within the heater housing 210 (e.g., at the base of the housing enclosure), electrically connected (e.g., by a wired connection) with the controller 240. The anti-tip sensor 246 is configured to indicate to the controller 240 (e.g., by transmitting a signal, altering a signal, or discontinuing transmission of a signal) if the heater 200 is tipped to a threshold angle (e.g., at least 30° from a fully upright position, causing the controller 240 to actuate the shutoff valve 242 to the closed or shutoff condition.

Figure 4A:
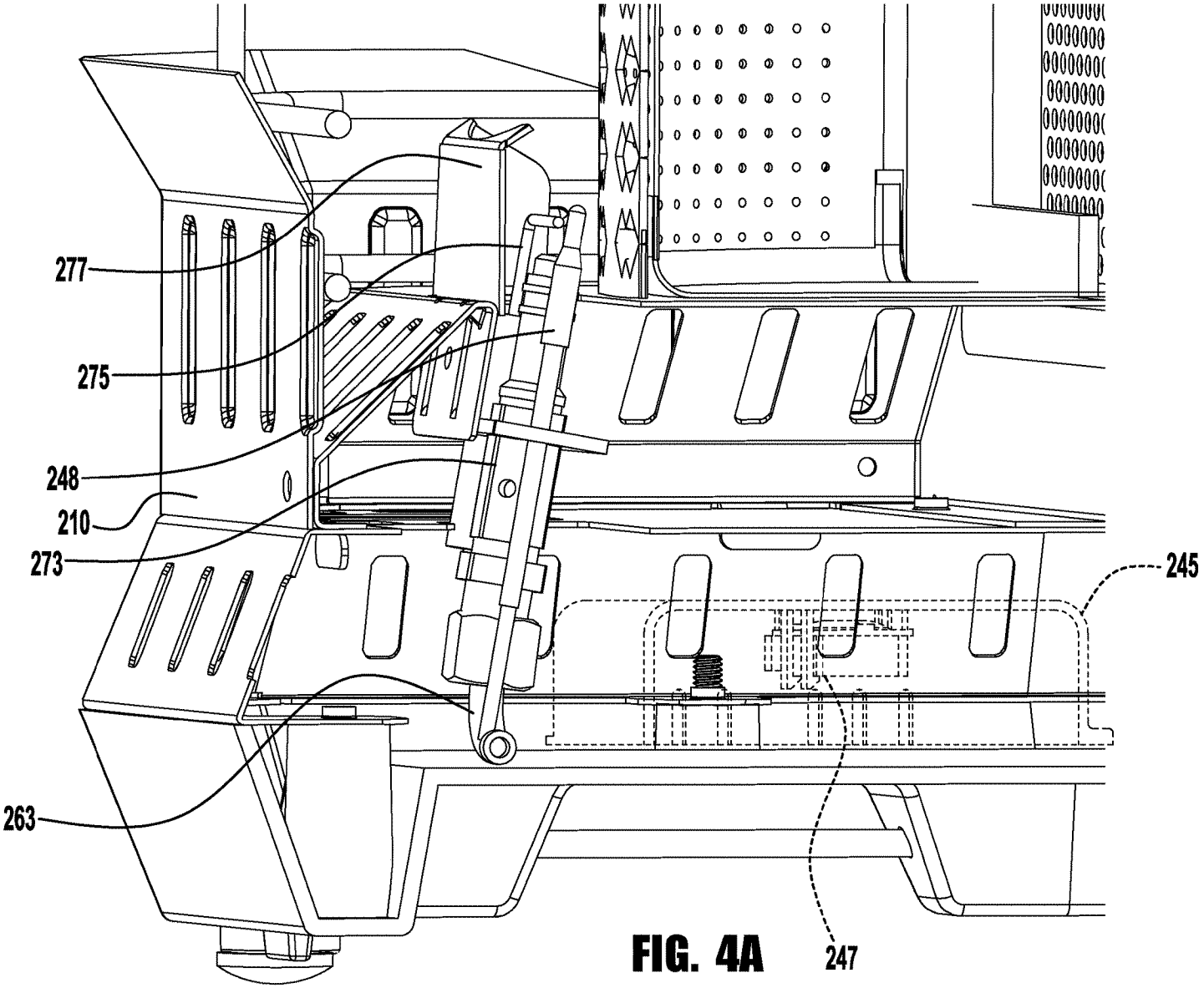
FIG. 4A is an enlarged cross-sectional side perspective view of a lower portion of the portable heater of FIG. 2.

As another example, an environmental sensor may be provided to detect a potentially hazardous environmental condition, such as, for example, a potentially unsafe amount of carbon dioxide and/or carbon monoxide in the air surrounding the heater. In the illustrated embodiment, an electronic gas sensor (shown in phantom at 247) is disposed in the heater housing 210, electrically connected (e.g., by a wired connection) with the controller 240. The sensor 247 is configured to indicate to the controller 240 (e.g., by transmitting a signal, altering a signal, or discontinuing transmission of a signal) if a predetermined threshold level of a toxic gas (e.g., 0.85-2.0% carbon dioxide, 0.01% carbon monoxide) is detected, causing the controller 240 to actuate the shutoff valve 242 to the closed or shutoff condition. While the gas sensor may be provided in a variety of locations on or within the heater housing, in the illustrated embodiment, a vented sensor enclosure 245 is secured to a bottom portion of the housing 210 to provide a secure enclosure for the sensor 247. As evident in FIG. 4A, the sensor 247 may be secured to an upper wall of the enclosure 245 (e.g., by flexible tabs, as shown), for example, to further protect the sensor from rainwater or other moisture within the heater enclosure.

As another example, a flame sensor (e.g., thermocouple) may be provided proximate to the pilot burner to detect a condition in which the pilot flame has been extinguished, which may provide an indication of low fuel or continued supply of unignited fuel in the absence of the pilot flame. In the illustrated embodiment, a thermocouple sensor 248 is provided adjacent to the pilot burner 273, electrically connected (e.g., by a wired connection) with the controller 240. The thermocouple 248 is configured to indicate to the controller 240 (e.g., by transmitting a signal, altering a signal, or discontinuing transmission of a signal) the absence of a pilot flame (e.g., a temperature below a minimum threshold), causing the controller 240 to actuate the shutoff valve 242 to the closed or shutoff condition.

While the controller 240 may be configured to continuously monitor the sensors 246, 247, 248 for signals identifying a condition for which valve shutoff is desired, in other embodiments, the controller may be allowed to sleep when the heater 200 is not used (e.g., when the operating knob is in the off position), for example, to preserve battery power. In such an arrangement, one or more switches may be utilized to identify use of the heater, with the switch(es) being connected with the controller to wake up the controller to facilitate monitoring. For example, as shown in FIG. 5, a switch, shown in phantom at 239, connected with the controller 240 (e.g., by a wired connection) may be provided adjacent to the knob 235 and may be configured to be actuated when the knob is rotated out of the off position, thereby sending a wake-up signal to the controller 240.

While many different electronically actuated shutoff valve arrangements may be utilized, in one embodiment, a shutoff valve may be maintained in an open position by an electrical current supplied from the controller to the shutoff valve, such that the controller actuates the shutoff valve to the closed or shutoff condition by terminating the supply of current to the shutoff valve. One example of such a shutoff valve is a normally open (or energized to open) thermoelectric shutoff valve, in which current supplied to a thermocouple in the valve causes a coil or magnet to move a valve sealing element to an open position, thereby holding the valve in an open condition. When the current to the thermocouple is discontinued, the coil or magnet automatically moves the valve sealing member to a closed position.

Figure 8:
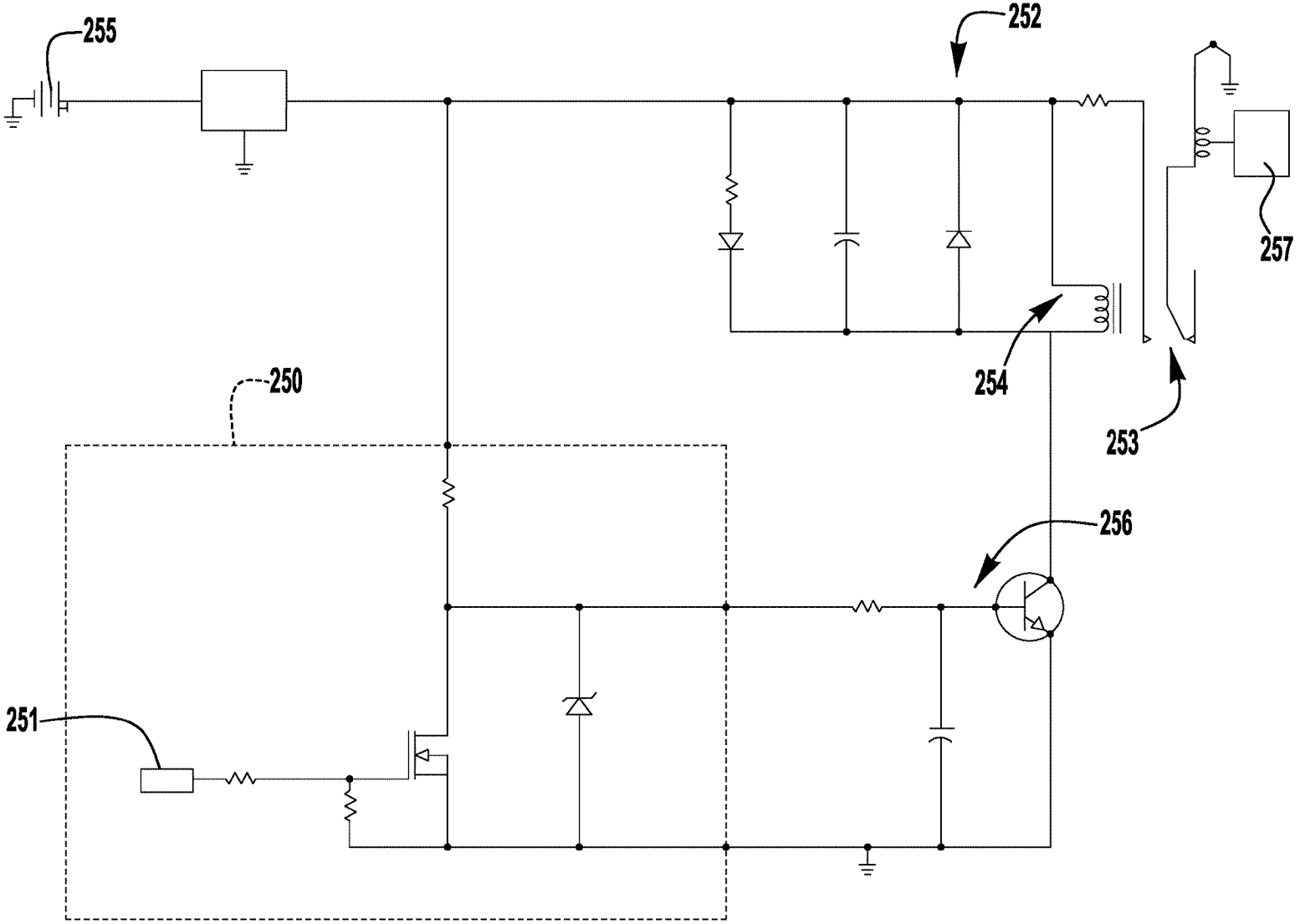
FIG. 8 is a schematic circuit diagram of an exemplary safety sensor system for a heater.

According to another aspect of the present application, a battery powered sensor may be provided in a circuit configured to cause the safety shutoff valve to close in the event that battery power is interrupted (e.g., depleted, disconnected) from the sensor. In an exemplary embodiment, as illustrated in the circuit schematic of FIG. 8, a battery-powered sensor module 250 including an environmental (e.g., carbon dioxide) sensor 251 is provided with a safety circuit 252 that supplies current to close a normally open switch 253 (e.g., thermoelectric magnet), thereby maintaining a magnetic shutoff gas valve 257 in an open condition to supply fuel to the heater's combustion chamber. When a potentially unsafe (e.g., high level of carbon dioxide) condition is detected by the sensor, current to the safety circuit is discontinued, and a failsafe relay 254 is opened, causing the normally open switch 253 to open, and the magnetic shutoff gas valve 257 to close, thereby eliminating the supply of fuel to the heater's combustion chamber. If power to the environmental sensor is interrupted (e.g., the battery 255 is disconnected from the sensor module 250), the failsafe relay 254 is also opened to cause the magnetic valve 257 to shut off, thereby preventing the heater from running in potentially unsafe conditions that would otherwise have been detected by the environmental sensor (if it was being powered). The circuit may also include a cutout alarm 256 to provide a visual (e.g., LED indicator light) or audible (e.g., tone generating speaker) indicator of the sensed condition.

Additionally or alternatively, when one of the sensors detects a condition indicative of an undesired environment for operation of the heater 200 and/or accessory (e.g., low levels of oxygen, high levels of carbon dioxide and/or carbon monoxide, extreme temperature, or a tipped over condition), the controller 240 may be configured to disable the ignitor 274, for example, by opening a circuit between the controller 240 and the ignitor 274.

According to another aspect of the present disclosure, a user interface on the heater may provide one or more warning outputs (e.g., visual and/or audible) identifying unsafe/undesirable and/or shutoff conditions. For example, the heater housing 210 may be provided with one or more LED's (FIG. 7) electrically connected with the controller 240 and powered through the controller to identify one or more conditions, including, for example, tipped condition, pilot extinguished condition, high carbon dioxide condition, low battery condition, and/or low fuel condition. Multiple conditions may be identified, for example, using multi-colored LED's, multiple LED's, and/or one or more audible alerts. While the warning outputs may coincide with a shutoff threshold (e.g., low oxygen, high carbon dioxide or carbon monoxide), in other embodiments, the controller may be configured to activate the warning output at a first threshold (e.g., 19% oxygen, 0.75-1.9% carbon dioxide, 0.05-0.09% carbon monoxide), and to operate the shutoff valve at a second threshold (e.g., 18% oxygen, 0.85-2.0% carbon dioxide, 0.010% carbon monoxide) beyond the first threshold (e.g., lower for oxygen, higher for carbon dioxide or carbon monoxide).

The controller 240, the ignitor 274, and the sensors 246, 247, 248 are electrically connected with (e.g., directly or indirectly) and powered by one or more batteries 244 (e.g., replaceable and/or rechargeable batteries, such as, for example AA batteries). These batteries may be retained, for example, under the access door 214 of the heater housing, for example, to provide easy access to the batteries while protecting the batteries from moisture or other contamination. Additionally, or alternatively, a micro-USB port 249 or other such power supply connection may be provided on the heater housing 210 (e.g., under the access door 214, as shown) to provide an alternative or backup power supply to the heater components. In other embodiments, the heater may additionally or alternatively include a power cord, for example, for electrical connection with a wall outlet to power the controller, ignitor, and sensors.

Figure 2:
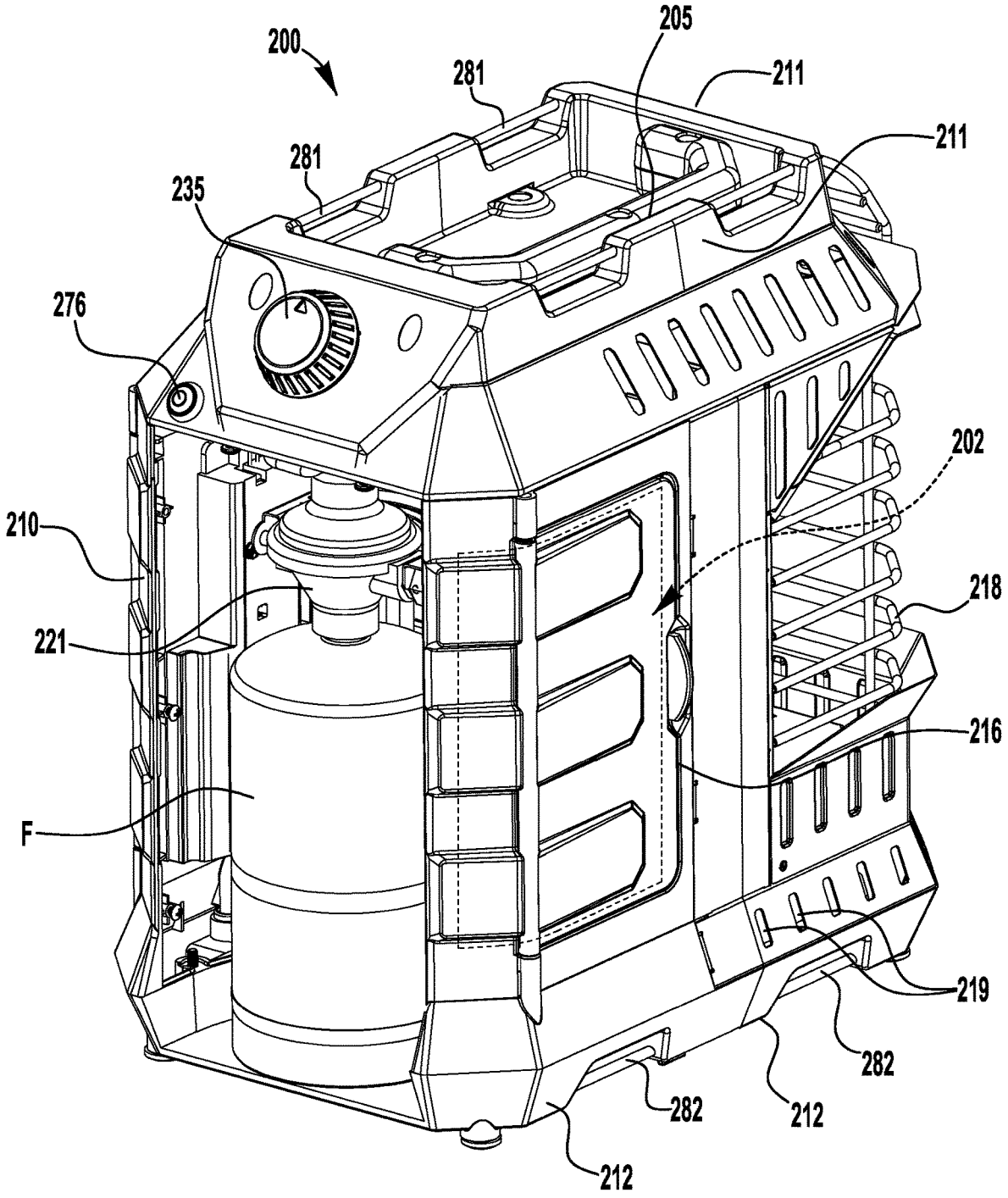
FIG. 2 is an upper rear perspective view of a portable heater, according to an exemplary embodiment of the present disclosure.
Figure 3:
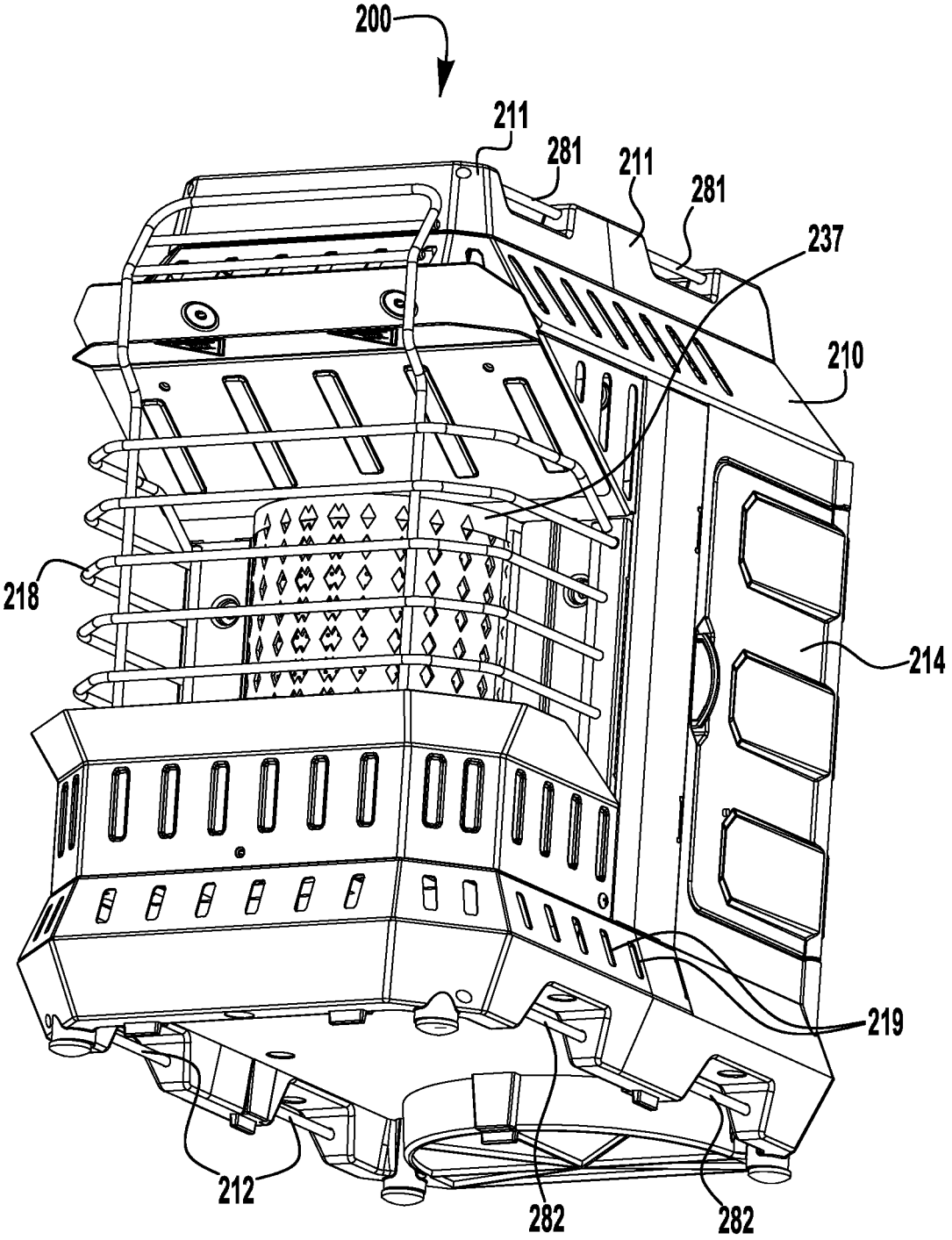
FIG. 3 is a lower front perspective view of the portable heater of FIG. 2.

According to additional aspects of the present disclosure, other features may additionally or alternatively be provided on a portable heater. For example, as shown in FIG. 2, a storage compartment 202 may be defined by the heater housing 210, and enclosed by a storage door 216, which may be similar to, and on the opposite side of the housing from, the access door 214 covering the accessory fueling connector 225. As another example, a handle 205 may be attached to the upper portion of the heater housing 210 and may be pivotable to be received in a recessed area defined by vertically extending end wall portions 211.

As another example, an upper portion of the heater housing 210 may be configured to utilize heated air from within the heater housing 210 to provide a warming surface (e.g., plate or cupholder) to warm items placed on the warming surface (e.g., beverages, tools, gloves, etc.). Warming may be provided by passing heated air through vent holes in the heater housing or by conducting heat through a thermally conductive material at the top portion of the heater housing. In one such embodiment, as schematically shown in FIG. 4, a self-regulated warming surface 206 on the heater housing may be provided using a thermal connection 207 between a heated thermally conductive element within the heater and a thermally conductive portion of the housing defining the warming surface. When a threshold temperature is exceeded at the thermal connection, the conductive heat path at the thermal connection is broken (e.g., by differing expansion of bi-metal connection components) to limit further heating of the warming surface.

Figure 9:
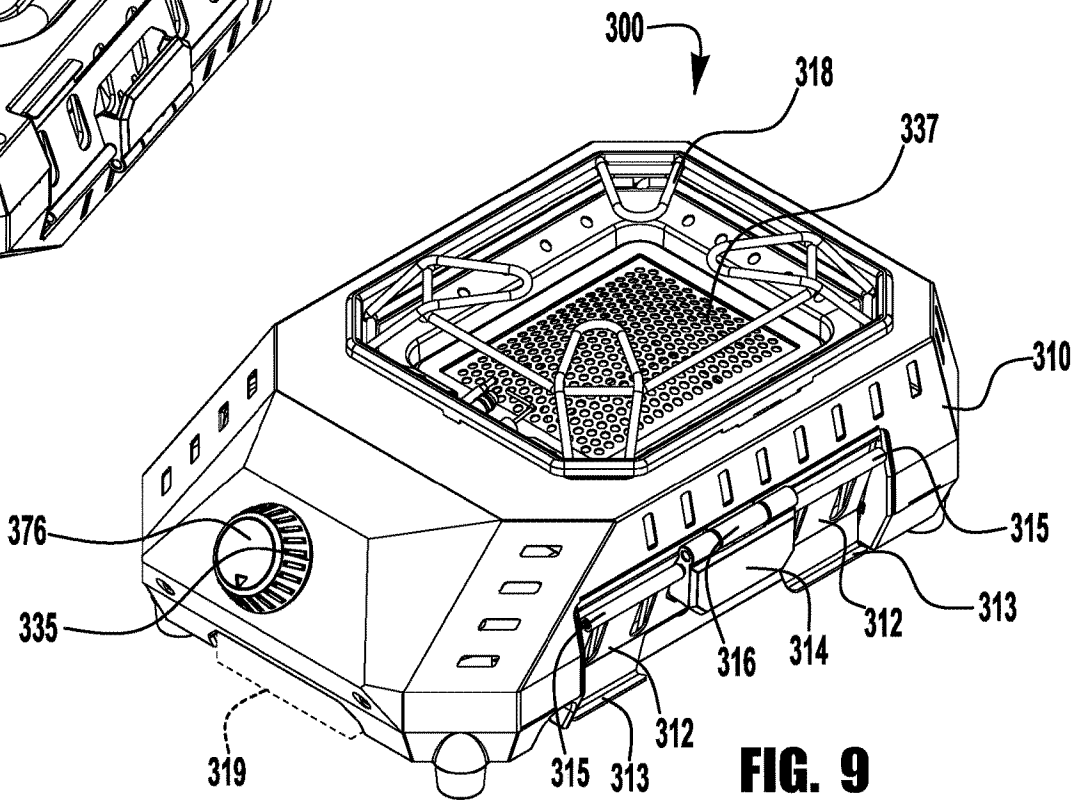
FIG. 9 is an upper front perspective view of a portable cooker accessory, according to an exemplary embodiment of the present disclosure.
Figure 11:
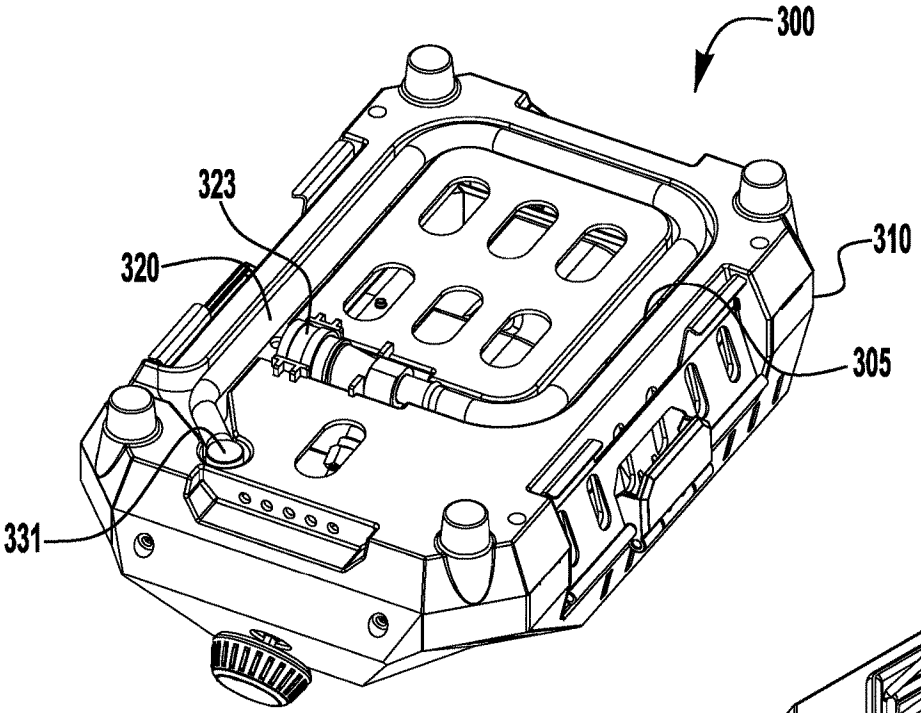
FIG. 11 is lower front perspective view of the cooker accessory of FIG. 9.
Figure 10:
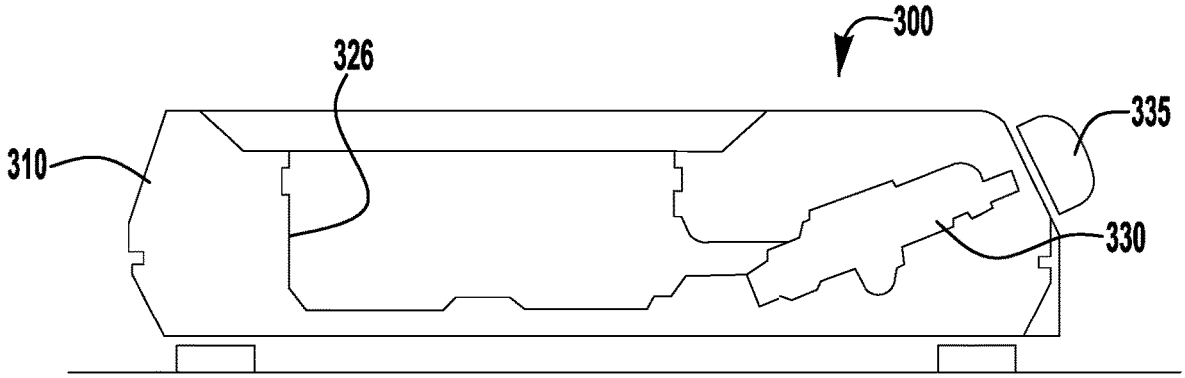
FIG. 10 is a cross-sectional side view of the cooker accessory of FIG. 9.

FIGS. 9-11 illustrate an exemplary fuel-fired cooker accessory 300 for use with a heater having an accessory fueling connector (e.g., the heaters 100, 200 described herein). As shown, the cooker 300 includes a housing 310, a combustion chamber 326 (FIG. 10) disposed in the housing, a supply valve 330 (with user operable knob 335) connected with the combustion chamber for supplying fuel to the combustion chamber, and an ignitor (e.g., piezoelectric ignitor, electronic spark ignitor) for igniting the supplied fuel in response to user operation of an ignition button 376 (which may be integrated with the knob 335, as shown), a burner element 337 (e.g., screen or tile) disposed above the combustion chamber 326. An accessory hose 320 (FIG. 11) is provided with a first end connected to an inlet port 331 of the supply valve and a second end including an accessory supply connector 323 (e.g., a quick connect style connector) for connection with the accessory fueling connector of the heater. As described above and in the above incorporated '383 and '500 Applications, the accessory supply connector 323 may include a keying feature for limiting connection to a correspondingly keyed connector of the heater, for example, to limit use to an authorized heater/accessory combination. A burner element 337 (e.g., screen or tile) is disposed above the combustion chamber 326, and a grill frame 318 is provided for supporting cookware to be heated. The supply valve 330 may be a regulating valve configured to adjust the supply of fuel to the combustion chamber 326, for example, to adjust the heat generated by the cooker 300.

The cooker accessory 300 may be provided with other features, according to additional aspects of the present disclosure. For example, as shown in FIG. 11, the housing 310 may define a peripheral gap or channel 305 sized to receive the accessory hose 320 when the accessory is not in use (e.g., by winding the hose within the channel). As another example, a cutting board/heating plate (not shown) may be stowed within a recess in the underside of the cooker housing 310.

According to another aspect of the present disclosure, a heater and heater accessory (e.g., the cooker 300 of FIGS. 9-11) may be provided with an attachment arrangement for securing the heater and heater accessory together, for example, to facilitate storage and/or carrying of the heater and accessory together. While many different attachment arrangements may be utilized, in an exemplary embodiment, one of the heater and the accessory may be provided with mounting rails, and the other of the heater and the accessory may be provided with one or more latches for releasably attaching to the mounting rails. While the mounting rails are illustrated as elongated pins attached to or extending through portions of the housing end wall portions, in other embodiments, mounting rails may be formed as flanges, ribs or other such extensions that may interlock with one or more latches. In the exemplary heater 200 of FIGS. 2-6, mounting rails 281, 282 are provided on the upper and lower ends of the heater housing 210, secured to vertically extending end wall portions 211, 212 of the heater housing 210 to define attachment points for one or more latches 281*a*, 281*b* on a heater accessory 280*a*, 280*b*. While the mounting rails are illustrated as elongated pins attached to or extending through portions of the housing end wall portions, in other embodiments, mounting rails may be formed as flanges, ribs or other such extensions that may interlock with one or more latches including, for example, hooks, clips, posts, detents, or other such latch portions. A top mounted heater accessory 280*a* may be provided with an integrated handle 282*a* to facilitate carrying of the accessory/heater combination, while a bottom mounted heater accessory 280*b* may be provided with integrated feet, wheels, or other such ground-engaging elements 282*b* for stable support of the accessory/heater combination.

Figure 12:
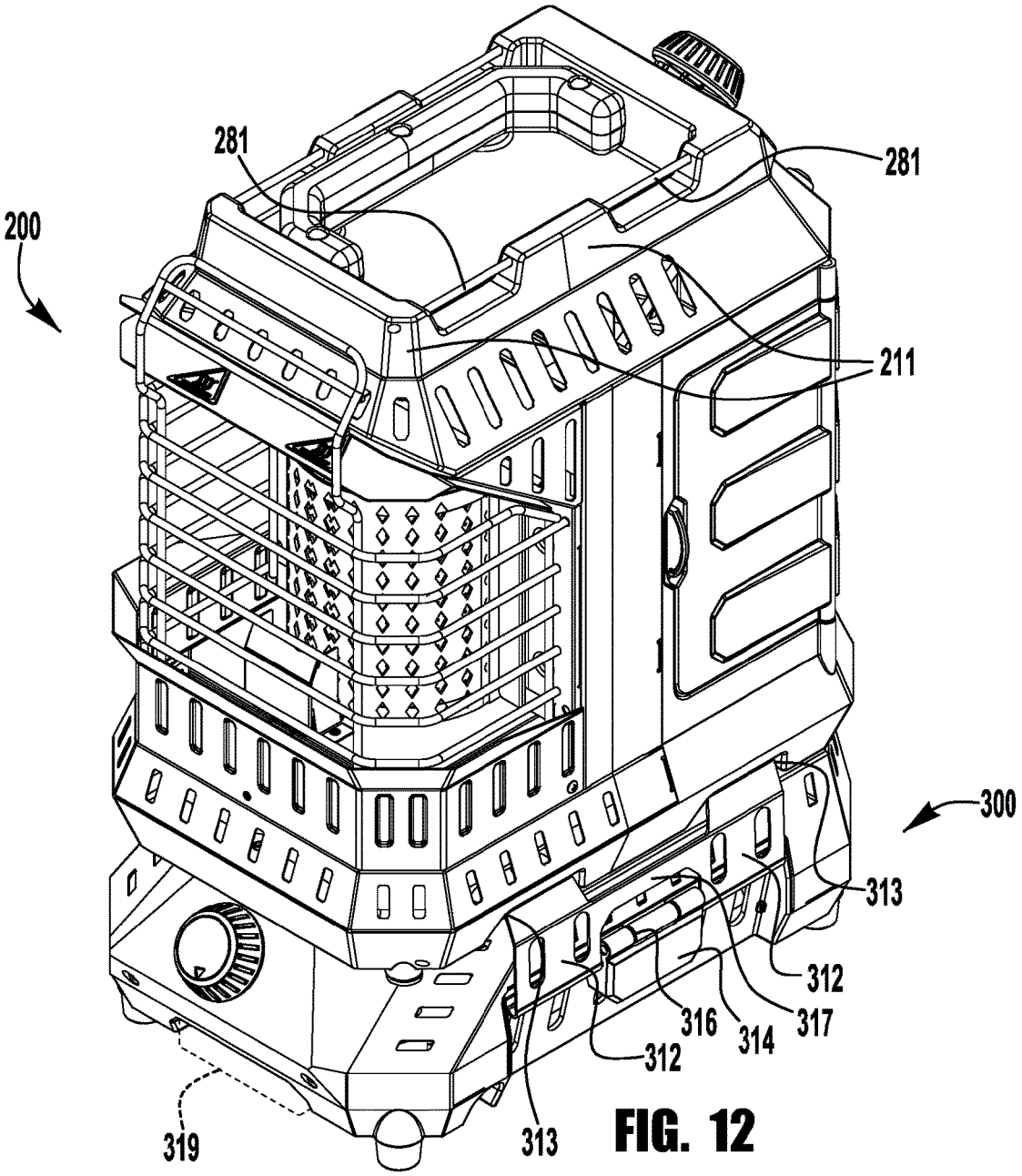
FIG. 12 is an upper front perspective view of the cooker accessory of FIG. 9 secured to a bottom portion of the portable heater of FIG. 2, according to an exemplary embodiment of the present disclosure.

In the exemplary cooker accessory 300 of FIGS. 9-11, latch portions 312 are provided on an upper portion of the cooker housing 310 (e.g., on one or both sides of the housing), with first ends defining endmost hook portions 313 that interlock with or hook over the lower mounting rails 282 of the heater 200 to secure the cooker accessory 300 below the heater housing 210 for attachment with the lower mounting rails 282, as shown in FIG. 12.

While may different types of latching/releasing arrangements may be utilized, in the illustrated embodiment, second ends of the latch portions 312 are hingedly connected to a release lever 314 at outer hinge portions 315 (e.g., by pivot pins). The release lever 314 includes a user graspable first end and a second end hingedly connected to the cooker housing 310 at a central hinge portion 316 offset from the outer hinge portions 315. With the release lever pivoted outward and upward, the latch portions 312 may be pivoted to extend the hook portions 313 over, but disengaged from, the mounting rails 282. In this condition, subsequent downward and inward pivoting of the release lever 314 pulls the outer hinge portions 315 downward to interlock the hook portions 313 with the mounting rails 282, securing the cooker accessory 300 below the heater housing 210 (e.g., to facilitate storage and/or carrying of the accessory 300 with the heater 200). To detach the accessory 300 from the heater 200, upward and outward pivoting of the release lever 314 raises the outer hinge portions 315 upward to disengage the hook portions 313 from the mounting rails 282, allowing the latch portions 312 to freely pivot outward and away from the mounting rails. As shown, the latch portions 312 may be integrally joined by a central rib portion 317, for example, to facilitate simultaneous pivoting of the latch portions with a single user movement. In other embodiments (not shown), the latch portions may be detached from each other for independent pivoting between the interlocking and releasing positions.

In other embodiments, an accessory may be provided with a latch releasing pedal (e.g., as shown schematically at 319 in FIGS. 9 and 12) operable (e.g., by a user's foot) to simultaneously disengage all of the latching portions 312 from the mounting rails 282, for example, by a linkage between the pedal 319 and the latching portions 312, or between the pedal and the release levers 314.

Additionally, as evident in FIG. 12, the heater housing 210 and cooker housing 310 may be provided with substantially matching peripheries (e.g., substantially the same size and shape, such as the chamfered rectangular peripheries of the illustrated heater 200 and accessory 300), for example, to further facilitate storage and carrying of the heater 200 and accessory 300 together.

While the exemplary heater 200 of FIGS. 2-6 provides an accessory fueling connector positioned to supply fuel to an accessory that is not directly mounted to the heater housing and is only mounted to the heater when not in use, in other embodiments, a heater may be configured to support or mount a fuel-fired accessory for use in a mounted condition.

Figure 13:
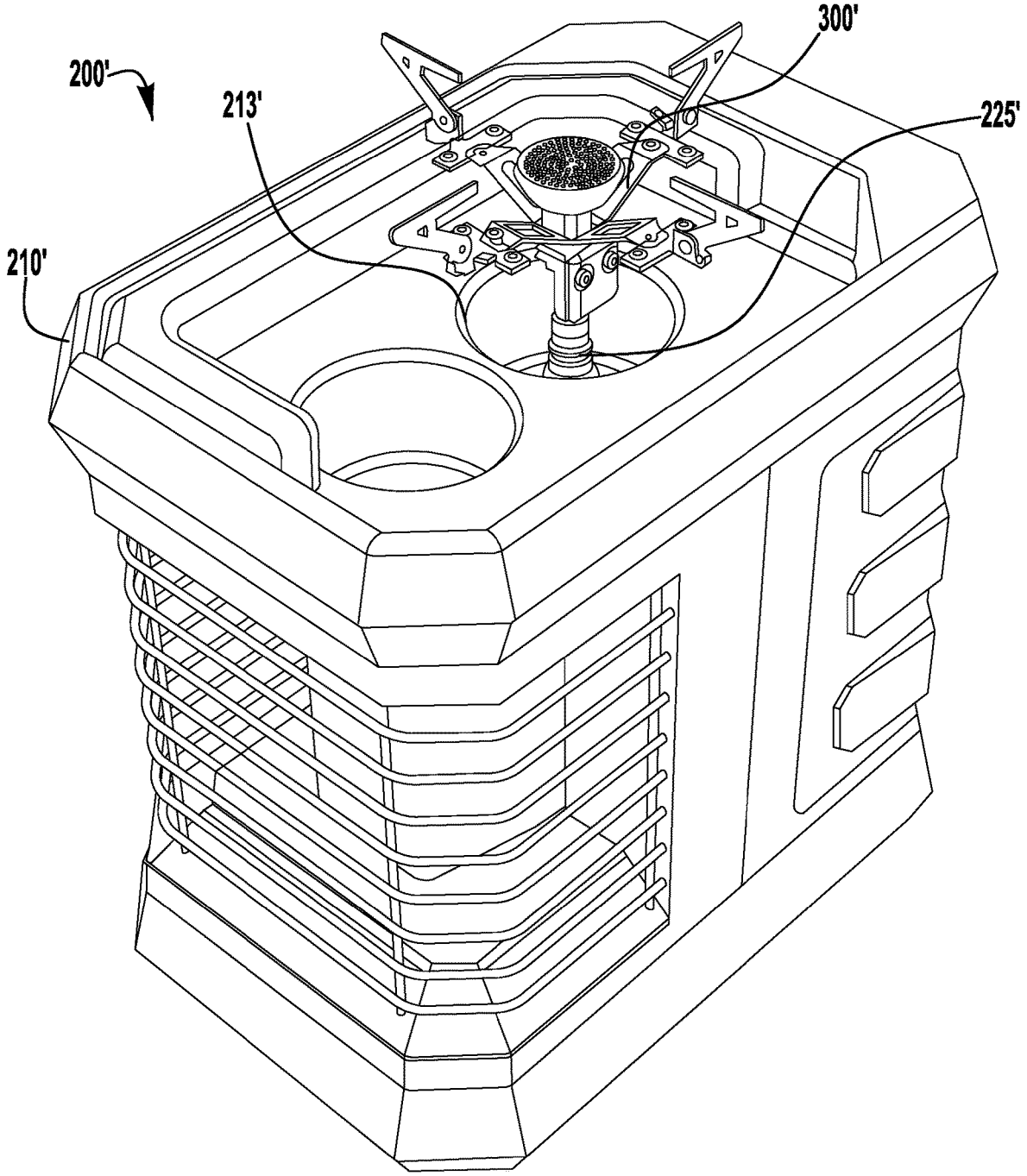
FIG. 13 is a perspective view of another portable heater and cooker accessory, according to another exemplary embodiment of the present disclosure.

For example, as shown in FIG. 13, a heater 200' may include an accessory fueling connector 225' disposed in an upper recessed portion 213' (which may be similar in size and shape to a cupholder) of the heater housing 210' for connection to, and support of a Jetboil® style camping stove 300'. In such an arrangement, fueling of a detached accessory (e.g., the cooker 300 of FIGS. 9-11) may also be provided, for example, by connection of the connector 323 with the accessory fueling connector 225'.

Many other types of fuel-fired accessories may be provided for use with a fuel diverting heater as contemplated by the present disclosure. For example, one or more of a fuel-fired gas lantern, warming enclosure (e.g., for a spare fuel tank), and boot/glove dryer may additionally or alternatively be provided. Such accessories may, but need not, be configured for mounted attachment to the heater (for example, using the mounting rail and latch arrangement described above), either during storage/carrying of the heater and accessory, or during use of the fuel fired accessory (e.g., using an accessory fueling connector disposed on the top or bottom end of the heater housing.

Other non-fuel-fired accessories 280*a*, 280*b* may additionally or alternatively be provided for use with a fuel-fired heater, as contemplated by the present disclosure. For example, pivoting and/or telescoping/extensible heater support legs or an oscillating heater base (e.g., powered by a self-contained battery, a power cord connectable to a wall outlet, or an electrical connection with the heater power source) may be attached to a bottom end of the heater housing, for example, using the mounting rails described above, or a recessed portion of the bottom end of the housing (e.g., defined by end walls) to matingly receive an upper portion of the accessory attachment.

As another example, an electrically powered accessory 280*a* may be attached to a top end of the heater housing, for example, using the mounting rails described above, or a recessed portion of the top end of the housing (e.g., defined by end walls or cup holder(s)) to matingly receive a lower portion of the accessory attachment. For example, a battery carrying (e.g., lithium ion battery) power bank accessory may be attached to the top end of the heater housing, to provide charging ports (e.g., USB ports) for charging electronic devices (e.g., smart phones). The power bank accessory may additionally be configured to be electrically connected to the electrically powered components of the heater (e.g., controller, ignitor, sensors) to preserve the heater's on-board batteries. An electrically powered accessory may additionally or alternatively include one or more of a powered fan, LED light(s), Bluetooth speakers, radio, or other such devices. In some embodiments, the top mounted accessory may be provided with a handle to facilitate carrying of the heater/accessory combination Still other heater mountable non-fuel-fired accessories may be configured to make use of the heat generated by the heater, for example, to perform warming and/or drying functions. For example, a warming tool tray or warming box/chamber (e.g., for a spare fuel tank) may be mountable to the top portion of the heater housing (e.g., using the mounting rails described above, or a recessed portion of the top end of the housing) to receive heat radiating from the upper end of the housing (e.g., through vent holes or a thermally conductive material at the top portion of the heater housing). Such an arrangement may, for example, utilize a self-regulated warming element as described above.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

What is claimed is:

1. A portable heater comprising:

a housing enclosing a combustion region;

first and second connectors disposed on an exterior of the housing;

a valve arrangement disposed within the housing and in fluid connection with the first connector;

a first supply line disposed within the housing and in fluid connection between the valve arrangement and the combustion region for supplying fuel to the combustion region when a fuel source is connected with the first connector;

a second supply line disposed within the housing and in fluid connection between the valve arrangement and the second connector, the second connector supplying fuel to a fuel-fired accessory when the fuel source is connected with the first connector and the fuel-fired accessory is connected with the second connector; and the valve arrangement being operable to selectively supply fuel to the combustion region and the second connector when the fuel source is connected with the first connector.

2. The portable heater of claim 1, further comprising:

a controller disposed within the heater housing;

at least one sensor in circuit communication with the controller, the at least one sensor being configured to detect a predetermined condition of the heater; and a shutoff valve disposed between the first connector and the first and second supply lines and in circuit communication with the controller;

wherein the controller is configured to actuate the shutoff valve to a closed condition when the at least one sensor detects the predetermined condition of the heater.

3. The portable heater of claim 2, wherein the at least one sensor comprises at least one of a gas sensor, a flame sensor, and an anti-tip sensor.

4. The portable heater of claim 2, wherein the controller supplies an electrical current to maintain the shutoff valve in an open condition, such that when the electrical current from the controller is discontinued, the shutoff valve automatically moves to the closed condition.

5. The portable heater of claim 2, further comprising at least one battery for powering at least one of the controller, the at least one sensor, and the shutoff valve.

6. The portable heater of claim 2, further comprising an electrical port for connecting with an external battery pack to power at least one of the controller, the at least one sensor, and the shutoff valve.

7. The portable heater of claim 1, wherein the second connector provides a detachable connection for the fuel-fired accessory.

8. The portable heater of claim 1, further comprising a pilot burner adjacent to the combustion region and a third supply line connecting the valve arrangement to the pilot burner.

9. The portable heater of claim 8, wherein the valve arrangement is operable between a first position supplying fuel to the pilot burner only, a second position supplying fuel to the pilot burner and the combustion region, a third position supplying fuel to the pilot burner and the second connector, and a fourth position shutting off flow to the pilot burner, the combustion region, and the second connector.

10. The portable heater of claim 1, further comprising an access door disposed on a side of the housing, the access door covering at least one of a storage space, the second connector, a battery compartment, and an electrical port.

11. The portable heater of claim 1, further comprising a burner element defining a radiant surface, wherein the burner element is semi-cylindrical.

12. In combination, the portable heater of claim 1 and a fuel-fired accessory including a fuel consuming feature and an accessory supply connector connected with the fuel consuming feature by an accessory supply line.

13. A mountable accessory in combination with the portable heater of claim 1, the accessory comprising:

a housing;

a release lever having a user graspable first end and a second end hingedly connected to the housing at a first hinge portion; and at least one latch portion having a first end for interlocking with a mount portion of the portable heater and a second end hingedly connected to the release lever at a second hinge portion offset from the first hinge portion, such that pivoting movement of the release lever from an engaging position to a releasing position extends the latch portion to disengage the first end from the portion.

14. The accessory of claim 13, further comprising a fuel consuming feature supported by the housing, and an accessory supply connector connected with the fuel consuming feature by an accessory supply line, the accessory supply connector being connectable with a connector of a fuel-fired portable heater to supply fuel from the fuel-fired portable heater to the fuel consuming feature.

15. A combination comprising:

the portable heater of claim 1, and a mountable accessory comprising a housing, wherein one of the portable heater and the mountable accessory comprises first and second mounting rails on opposite first and second sides of the corresponding housing, and the other of the portable heater and the mountable accessory comprises configured to attach to at least one of the mounting rails.

16. The combination of claim 15, wherein the opposed mounting rails are disposed on a bottom end of the portable heater housing.

17. The combination of claim 15, wherein the accessory comprises a fuel-fired accessory.

18. The combination of claim 15, wherein the at least one latch comprises:

a release lever having a user graspable first end and a second end hingedly connected to the housing at a first hinge portion; and at least one latch portion having a first end defining a hook portion for interlocking with the at least one of the mounting rails and a second end hingedly connected to the release lever at a second hinge portion offset from the first hinge portion, such that pivoting movement of the release lever from an engaging position to a releasing position extends the latch portion to disengage the hook portion from the at least one of the mounting rails.

19. The combination of claim 15, wherein the mounting rails comprise elongated pins attached to portions of an end wall of the one of the portable heater and the mountable accessory.

* * * * *